US006844513B2

(12) United States Patent
Lipp et al.

(10) Patent No.: US 6,844,513 B2
(45) Date of Patent: Jan. 18, 2005

(54) APPLIANCE TIMER

(75) Inventors: Ellis P. Lipp, Charlottesville, IN (US); Laurence S. Slocum, Mooresville, IN (US); Robert C. Hammond, McCordsville, IN (US)

(73) Assignee: Emerson Electric Co., St. Louis, MO (US)

( * ) Notice: Subject to any disclaimer, the term of this patent is extended or adjusted under 35 U.S.C. 154(b) by 93 days.

(21) Appl. No.: 10/229,474

(22) Filed: Aug. 28, 2002

(65) Prior Publication Data

US 2003/0116558 A1 Jun. 26, 2003

Related U.S. Application Data

(60) Provisional application No. 60/342,937, filed on Dec. 21, 2001.

(51) Int. Cl.[7] ..... H01H 67/26
(52) U.S. Cl. ..... 200/179; 200/19.2
(58) Field of Search ..... 200/11 A, 11 D, 200/11 DA, 11 G, 374, 38 B, 11 R–11 T, 33 R–41, 19.07, 19.08, 19.12, 19.13, 19.15, 19.18, 19.2, 179

(56) References Cited

U.S. PATENT DOCUMENTS 3,109,073 A 10/1963 Lewis et al.
3,154,645 A 10/1964 Parlato
3,500,005 A 3/1970 Brown
3,819,886 A 6/1974 Homan et al.
4,346,271 A 8/1982 Cushing
4,362,953 A 12/1982 Bolin
4,449,384 A 5/1984 Jones
4,577,179 A 3/1986 Chambers et al.
5,042,311 A 8/1991 Duve et al.
5,570,520 A 11/1996 Huffington
5,668,359 A 9/1997 Alvord et al.
5,737,852 A 4/1998 Shukla et al.
5,782,012 A 7/1998 Sanders et al.
5,828,019 A 10/1998 Joyce
5,889,244 A 3/1999 Kraus
6,020,698 A 2/2000 Stenger et al.
6,048,486 A 4/2000 Fels et al.
6,064,011 A * 5/2000 Amonett ..... 200/11 DA

* cited by examiner

*Primary Examiner*—Thor Campbell
(74) *Attorney, Agent, or Firm*—Maginot, Moore & Beck

(57) ABSTRACT

An improved timer for controlling an appliance includes a camstack having a plurality of cam surfaces defined therein. A switch block cooperates with the plurality of cam surfaces to provide first switching operations for the appliance. A sensor detects rotation of the camstack, and generates position signals in response thereto. A processor is configured to receive the position signals and generate control signals in response thereto, wherein an auxiliary switching operation is performed in response to generation of the control signals.

55 Claims, 21 Drawing Sheets

APPLIANCE TIMER

PROVISIONAL PATENT APPLICATION

This application claims the benefit of U.S. Provisional Application Ser. No. 60/342,937, filed Dec. 21, 2001.

BACKGROUND OF THE INVENTION

1. Field of the Invention

The present invention generally relates to appliance timers, and more particularly, to an appliance having a timer with a sensor for facilitating, among other things, additional switching functions for the appliance.

2. Background of the Invention

Appliance timers are commonly used in many household appliances, such as clothes washers, clothes dryers, dishwashers, etc. The appliance timer controls operation of the appliance by actuating and deactuating switch assemblies which start and stop various functions within the appliance such as a rinse function in the case of a clothes washer. The switch assemblies within the appliance timer are actuated and deactuated as a result of interaction between a number of cam followers which are respectively associated with the switch assemblies.

The switch assemblies are generally grouped into a number of switch blocks associated with the appliance timer. For example, one common switch block configuration includes eight switch assemblies. Moreover, each of the switch assemblies typically includes an upper circuit blade and a lower circuit blade, with an intermediate circuit blade positioned therebetween. The circuit blades are moved into and out of contact with one another in order to make and break, respectively, a number of circuits. In particular, if the circuit blade has a cam follower molded or otherwise secured thereto, the circuit blade may be moved into and out of contact with other circuit blades via cooperation with one of the cam surfaces defined in the camstack. Alternatively, if the circuit blade is configured without a cam follower, the circuit blade will remain stationary until another circuit blade associated with the switch assembly is moved into or out of contact therewith. One common switch assembly arrangement includes an upper and a lower switch blade, each of which is configured without a cam follower. Actuation of the switch assembly occurs as an intermediate circuit blade, which has a cam follower secured thereto, is selectively lifted into contact with the upper circuit blade or dropped into contact with the lower circuit blade.

One way to categorize appliance timers is by the number of switch blocks included in the timer. For example, appliance timers may be categorized as either "single block" timers or "double block" timers. As their respective names suggest, a single block timer includes a single switch block (e.g., a single group of eight switch assemblies in operative contact with the camstack), whereas a double block timer includes two switch blocks (e.g., two groups of switch assemblies each having eight switch assemblies in operative contact with the camstack).

Single block timers advantageously have fewer components relative to double block timers thereby reducing costs associated with the appliance timer. Hence, a number of single block timers have heretofore been designed for use in many household appliances. Such single block timers are used in conjunction with appliances which do not require the additional switching capacity associated with double block timers. For example, it is known that approximately 85% of the clothes washer and dishwasher models available in the appliance market may be operated with a single block timer. Therefore, the use of single block timers in such appliances provides the switching capacity necessary to operate the appliance without additional costs associated with double block timers.

However, the remaining models, often referred to as "high-end" models, require more complex timing functions which may be achieved with a double block timer. This is true since high-end models generally have additional features associated therewith thereby increasing the number of switches required for operation of the appliance. As alluded to above, while use of such double block timers increases the switching capacity associated with the timer, costs associated with the timer are also increased thereby disadvantageously increasing costs associated with the appliance. What is needed therefore is an appliance timer which has greater switching capacity, and hence greater functionality, relative to single block timers which have heretofore been designed, but has fewer components relative to double block timers which have heretofore been designed.

One attempt at such an appliance timer is disclosed in U.S. Pat. No. 6,064,011 issued to Amonett, the disclosure which is totally hereby incorporated by reference in its entirety. Referring to FIG. 1, an appliance timer of the type disclosed in the Amonett '011 patent is shown. In particular, the appliance timer of FIG. 1 includes a voltage source 13, first machine components 15, second machine components 17, a switch block 22, a camstack 24, and an auxiliary assembly 26. The switch block 22 includes switch wafers 28, 32 and 36. The auxiliary assembly 26 is provided to increase appliance switching capacity and functionality, and includes an auxiliary member 62 bearing a circuit pattern 72, and an auxiliary wafer 76 having conductive arms 74.

As indicated in FIG. 1, the voltage source 13 provides a voltage signal to the switch wafers 28, 32 and 36 of the switch block 22, and the auxiliary wafer 76 of the auxiliary assembly 26. As the camstack 24 rotates, the switch wafers 28, 32 and 36 of the switch block 22 perform switching operations that control the first machine components 15, such as motors or heaters. Accordingly, the first machine components 15 may include heavy-duty circuits (e.g., circuits which carry a current of 13 to 15 amps) of an appliance.

Rotation of the camstack 24 also causes rotation of the auxiliary member 62 of the auxiliary assembly 26. As the auxiliary member 62 rotates, the conductive arms 74 of the auxiliary wafer 76 contact the circuit pattern 72 on the auxiliary member 62, and thereby generate voltage signals which control switching operations of the second machine components 17. However, in order to facilitate manual setting of the appliance timer by a user, the contact force between the conductive arms 74 and the circuit pattern 72 is relatively small so that, for example, a dial or other input means connected to the auxiliary member 62 can be easily rotated by a user. Because of this relatively small contact force, the electrical current generated by the auxiliary assembly 26 is also relatively small in magnitude. Accordingly, the second machine components 17 controlled by the auxiliary assembly 26 must be light-duty circuits (e.g., circuits which carry a current of less than 2 amps) of an appliance, namely circuits that operate features such as indicator lights, electrically-actuated water valves, etc. In other words, the auxiliary assembly 26 of FIG. 1 is not suitable to provide switching operations for heavy-duty circuits of an appliance.

Accordingly, there is a need for an appliance timer which, among other things, provides: (1) greater functionality relative to single block timers; (2) fewer components relative to double block timers; and (3) is suitable to accommodate switching for both light and heavy duty circuits. The present invention addresses these and other issues.

SUMMARY OF THE INVENTION

In accordance with the present invention, there is provided an improved timer for controlling an appliance. The timer includes a camstack having a plurality of cam surfaces defined therein. A switch block cooperates with the plurality of cam surfaces to provide first switching operations for the appliance. A sensor detects rotation of the camstack, and generates position signals in response thereto. A processor is configured to receive the position signals and generate control signals in response thereto, wherein an auxiliary switching operation is performed in response to generation of the control signals.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

The exemplifications set out herein illustrate preferred embodiments of the invention, and such exemplifications are not to be construed as limiting the scope of the invention in any manner.

DESCRIPTION OF THE PREFERRED EMBODIMENTS

Figure 1:
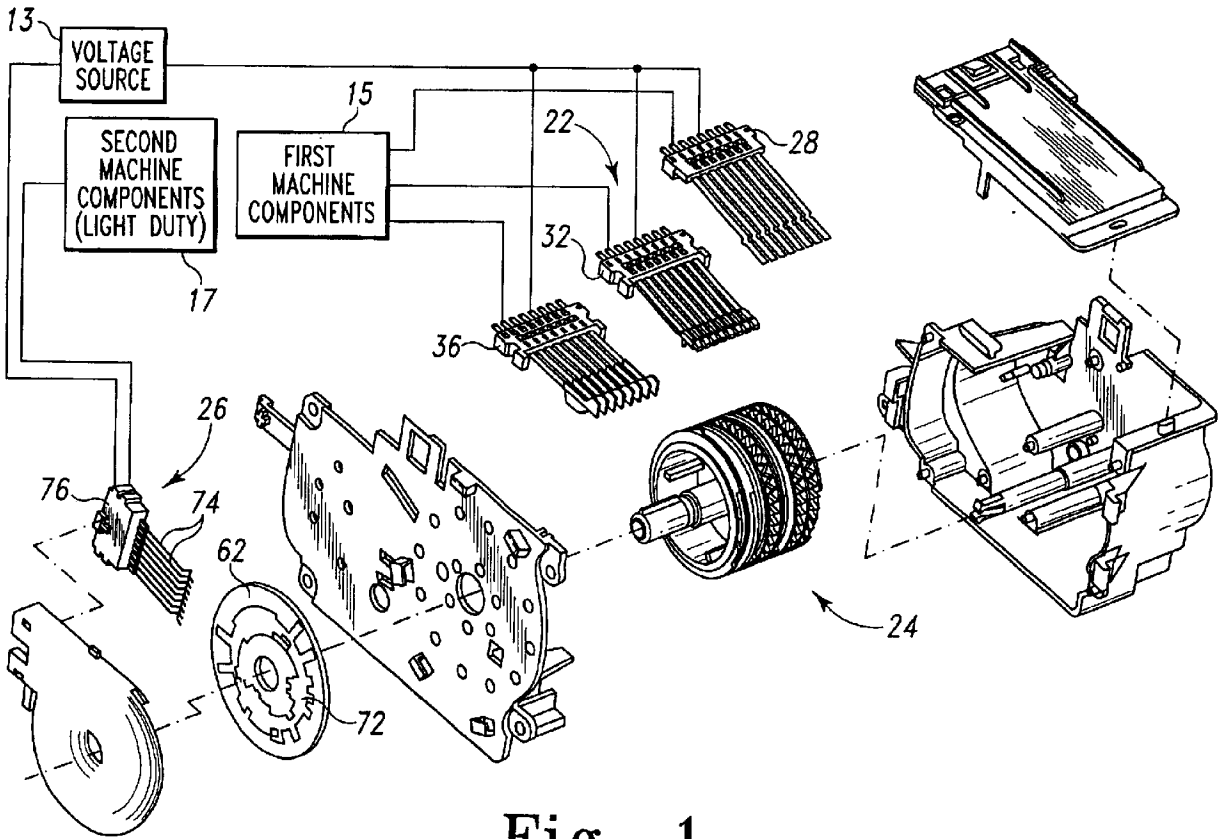
Fig. 1 (Prior Art)
FIG. 1 is a perspective view of an appliance timer constructed according to the prior art.
Figure 2:
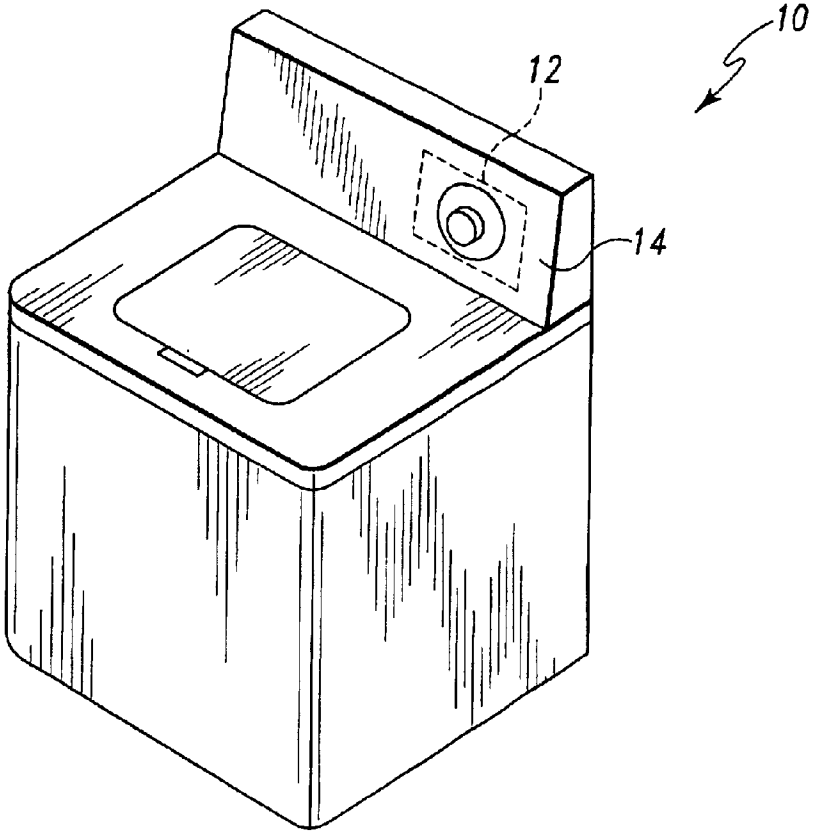
FIG. 2 is a perspective view of an exemplary appliance including an appliance timer constructed according to principles of the present invention.

Referring now to the drawings, and more particularly to FIG. 2, an exemplary appliance 10 including an appliance timer constructed according to principles of the present invention is shown. For purposes of example and explanation, the appliance 10 of FIG. 2 is shown as a clothes washer. However, the principles of the present invention may also be applied to other types of appliances having a timer, such as a clothes dryer or other device. In FIG. 2, the appliance 10 includes an appliance timer 12. The appliance timer 12 is secured to a console 14 of the appliance 10. In the case of a clothes washer, the appliance timer 12 controls various functions associated with the appliance 10, such as agitation, washing, spinning, drying, dispensing detergent or fabric softener, hot water filling, cold water filling, water draining, automatic temperature control, and other functions.

Figure 3:
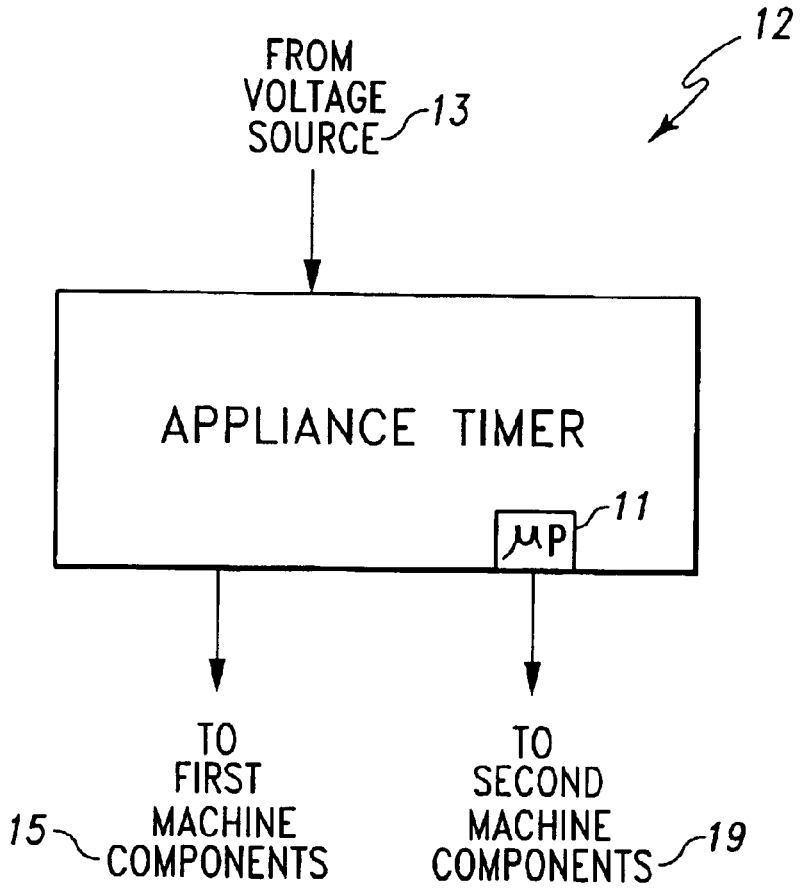
FIG. 3 is a block diagram of the appliance timer of FIG. 2.

Referring to FIG. 3, a block diagram of the appliance timer 12 of FIG. 2 is shown. Although not expressly shown in FIG. 3, the appliance timer 12 includes standard components (e.g., those components that are included in a single block timer) that control first machine components 15. The appliance timer 12 also includes a microprocessor ($\mu$P) 11 that is utilized to control second machine components 19, and thereby increase the number of operations capable of being performed by the appliance 10. In particular, the processor 11 receives input signals from a sensor configuration (not shown in FIG. 3) of the appliance timer 12, and controls operations of the appliance 10 based on those input signals to thereby increase the switching capacity and functionality of the appliance 10. The appliance timer 12 is powered via a voltage signal from a voltage source 13.

As previously discussed herein, at least one conventional mechanism used to increase appliance functionality has limited utility in that it cannot control certain heavy-duty circuits. Using the processor 11 rather than such conventional mechanisms to increase the functionality of the appliance 10 is particularly advantageous since the processor 11 is capable of controlling both heavy-duty and light-duty circuits of the appliance 10. As will be described later herein, the processor 11 receives position signals provided by various sensor configurations of the appliance 10, and generates control signals to thereby control operations of the appliance 10 based on the position signals.

Referring now to FIGS. 4 through 11, a first embodiment of the appliance timer 12 of FIG. 2 is shown. The first embodiment of the appliance timer 12 includes a housing member 16, a side plate 18, a top plate 20, a switch block 22, a camstack 24, an auxiliary assembly 26 and a microprocessor 11. The housing member 16, the side plate 18, and the top plate 20 cooperatively define a housing of the appliance timer 12. The switch block 22 controls first machine components 15, while the microprocessor 11 controls second machine components 19. The first and second machine components 15 and 19 may both include heavy-duty circuits (e.g., circuits which carry a current of 13 to 15 amps) of an appliance. A voltage source 13 provides a voltage signal to the switch block 22, the processor 11 and other components.

Figure 4:
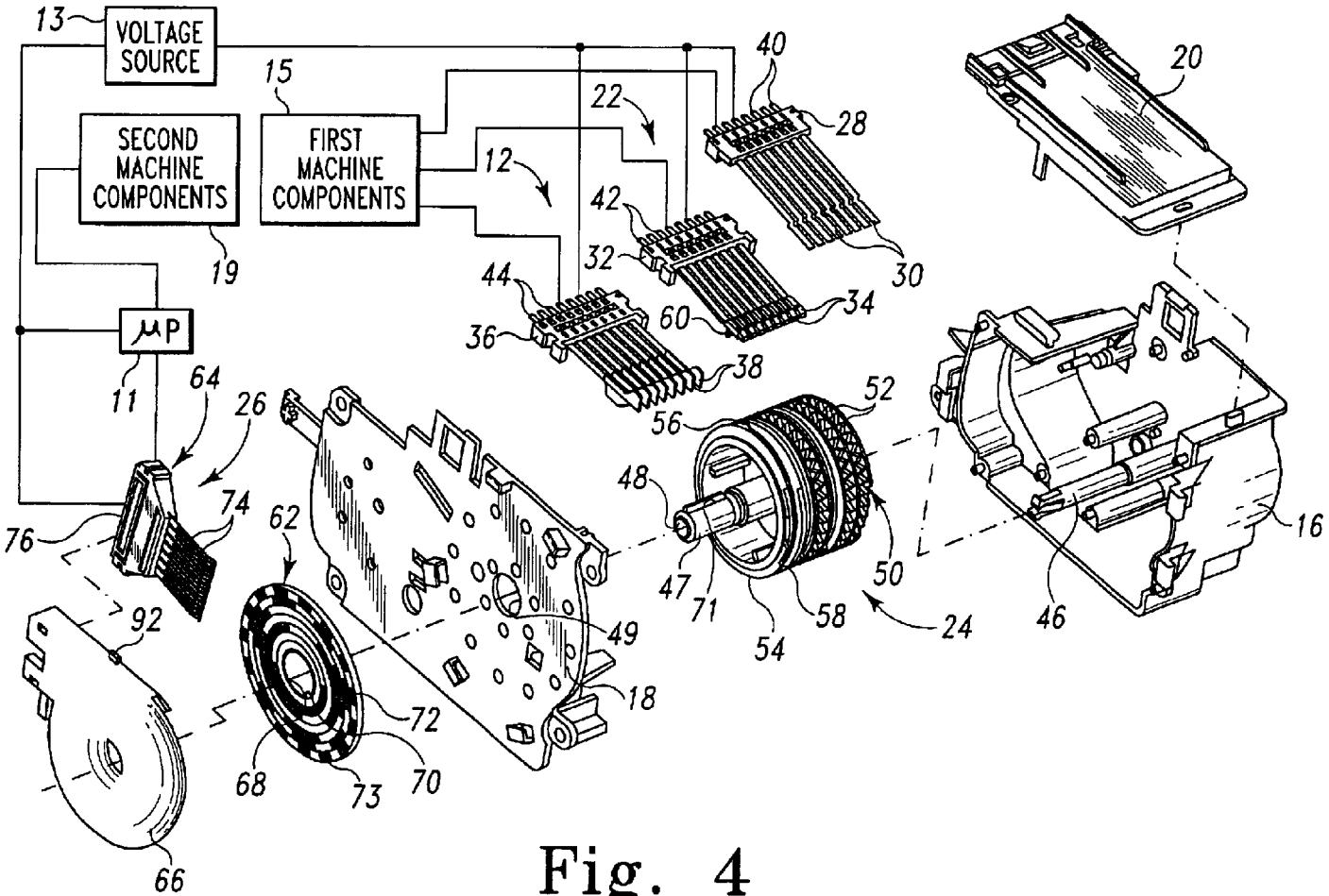
FIG. 4 is an exploded perspective view of a first embodiment of the appliance timer of FIG. 2 (note that a number of components associated with the appliance timer have been removed for clarity of description)
Figure 5:
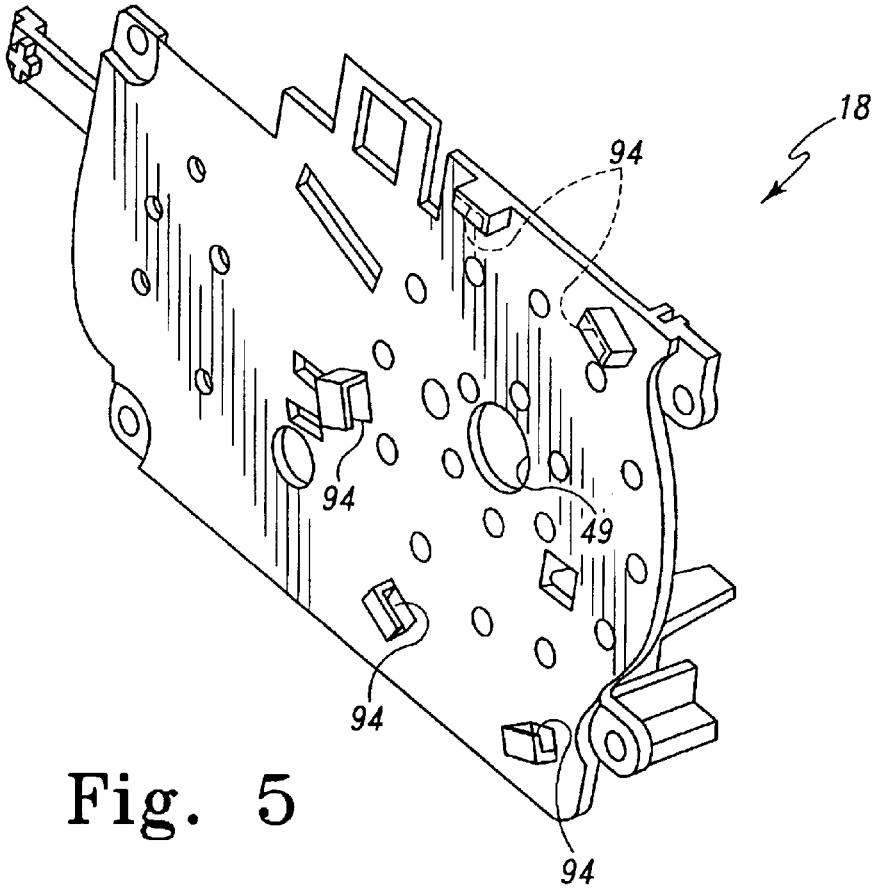
FIG. 5 is a perspective view of the side plate of the housing of the appliance timer of FIG. 4.

The switch block 22 preferably includes a number of switch assemblies. More specifically, the switch block 22 includes an upper switch wafer 28 having a number of upper circuit blades 30 secured thereto, an intermediate switch wafer 32 having a number of intermediate circuit blades 34 secured thereto, and a lower switch wafer 36 having a number of lower circuit blades 38 secured thereto. The circuit blades 30, 34 and 38 are preferably insert molded into the switch wafers 28, 32 and 36, respectively. One end of each of the circuit blades 30, 34 and 38 protrudes outwardly from the switch wafers 28, 32 and 36, respectively, thereby defining electrical terminals 40, 42 and 44, respectively, as shown in FIG. 4. The terminals 40, 42 and 44 are electrically coupled to the first machine components 15, such as a main machine motor (not shown) and a heater (not shown).

The camstack 24 is secured to a control shaft 46. In particular, the camstack 24 includes a hub 47 having a central bore 48 defined therein. The control shaft 46 is received through the central bore 48 in order to be secured to the camstack hub 47. One manner of securing the camstack hub 47 to the control shaft 46 is with a clutch mechanism (not shown). The camstack 24 rotates relative to the side plate 18. In particular, the side plate 18 has an aperture 49 defined therein. A first end of the camstack hub 47 is received through the aperture 49 thereby allowing the camstack hub 47 and hence the camstack 24 to rotate relative to the side plate 18.

The camstack 24 also includes a number of drive blades 50. Each of the drive blades 50 has a group of ratchet teeth 52 defined therein. The ratchet teeth 52 cooperate with a number of drive pawls (not shown) in order to provide for rotation of the camstack 24.

Moreover, the camstack 24 includes a number of program blades 54. The program blades 54 have a number of cam lifts 56 and a number of cam drops 58 defined therein. The drive blades 50 are non-rotatably coupled to each of the program blades 54. More specifically, rotation of any of the drive blades 50 causes rotation of each of the program blades 54.

Each of the intermediate circuit blades 34 has a cam follower 60 molded or otherwise secured thereto. The cam followers 60 cooperate with the program blades 54 of the camstack 24 as the camstack 24 is rotated in order to selectively make and/or break a number of electrical circuits. For example, during rotation of the camstack 24, one of the cam lifts 56 may be rotated into contact with a given cam follower 60 thereby causing the intermediate circuit blade 34 associated therewith to be lifted or otherwise urged into contact with a corresponding upper circuit blade 30. Similarly, during rotation of the camstack 24, one of the cam drops 58 may be rotated into contact with a given cam follower 60 thereby causing the intermediate circuit blade 34 associated therewith to be dropped or otherwise urged into contact with a corresponding lower circuit blade 38.

The appliance timer 12, as described herein, is a single block timer. More specifically, the camstack 24 is configured to include a predetermined number of the program blades 54 which are necessary to control a single switch block (i.e., the switch block 22). It should be appreciated that if additional switch blocks are added to the appliance timer 12, additional program blades 54 would likewise have to be added to the camstack 24 thereby increasing costs associated with the appliance timer 12.

The auxiliary assembly 26 and processor 11 are included in the appliance timer 12 of FIG. 4 to provide additional switching capacity without the need for an additional switch block. The auxiliary assembly 26 may be used in conjunction with a number of commercially available appliance timers. For example, the auxiliary assembly 26 may be used in conjunction with a model M620 Delta Timer having slight modifications thereto. The model M620 Delta Timer is commercially available from Emerson Appliance Controls of Indianapolis, Ind.

Figure 6:
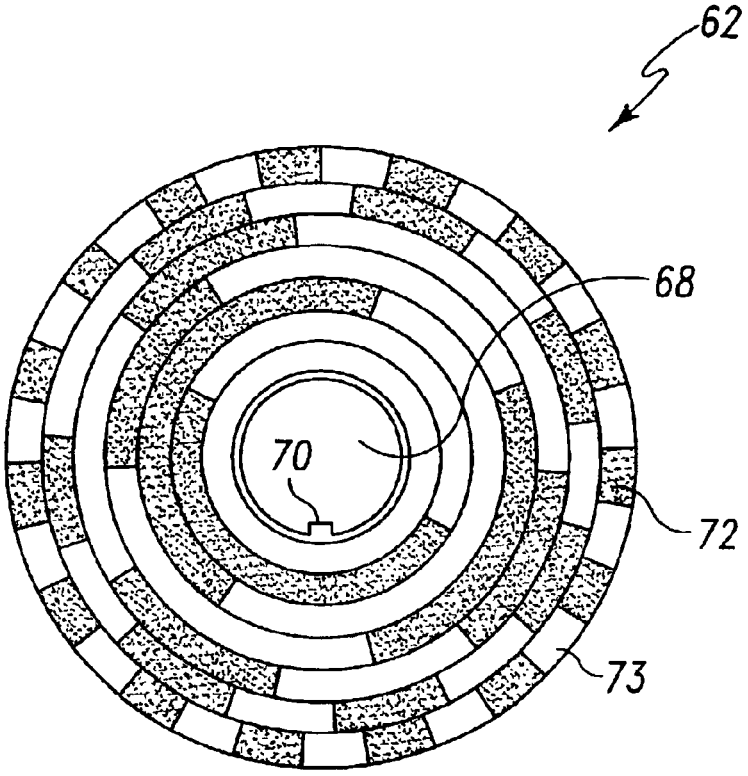
FIG. 6 is a top view of the auxiliary member of the appliance timer of FIG. 4.

The auxiliary assembly 26 includes an auxiliary member 62, an auxiliary wafer assembly 64, and an auxiliary cover 66. As shown in FIG. 6, the auxiliary member 62 is substantially circular in shape, and has an aperture 68 defined therein. Moreover, the auxiliary member 62 has a keying member or tab 70 defined therein. The aperture 68 and the keying tab 70 are provided to secure the auxiliary member 62 to the hub 47 of the camstack 24 (see FIG. 4). In particular, the camstack hub 47 is received through the aperture 68 such that the keying tab 70 is secured within a keying member or slot 71 defined in the camstack hub 47 thereby non-rotatably securing the auxiliary member 62 to the camstack hub 47. While the shown keying configuration has numerous advantages associated therewith, certain of these advantages may be achieved with other keying configurations. For example, a keying slot may be defined in the auxiliary member 62 with a corresponding keying tab defined in the camstack hub 47 thereby allowing the auxiliary member 62 to be non-rotatably secured to the camstack 24 when the camstack hub 47 is received through the aperture 68.

It should be appreciated that that securing the auxiliary member 62 to the camstack hub 47 via use of the keying tab 70 and the keying slot 71 causes the auxiliary member 62 to rotate dependently with the camstack 24. More specifically, as the drive pawls (not shown) of the appliance timer 12 drive the camstack 24 at a predetermined speed, the auxiliary member 62 is likewise driven at the same predetermined speed. Moreover, it should be appreciated that the camstack 24 and the auxiliary member 62 are rotated the same distance over a given period of time. In particular, if the drive pawls of the appliance timer 12 drive the camstack 24 a distance corresponding to one complete revolution thereof, the auxiliary member 62 will likewise be driven a distance corresponding to one complete revolution thereof.

Moreover, it should be noted that the auxiliary member 62 is secured to the camstack hub 47 such that the auxiliary member 62 is positioned outside the housing (i.e., the housing member 16, the side plate 18, and the top plate 20) of the appliance timer 12. Conversely, the camstack 24 (except for the portion of the hub 47 that extends through the aperture 49) is positioned inside the housing of the appliance timer 12. Of course, the auxiliary member 62 may be alternatively positioned within the housing.

The auxiliary member 62 is preferably made of a common circuit board material, such as epoxy or a phenolic resin, and has a circuit pattern 72 on a front side 73 thereof. The circuit pattern 72 may be printed and/or etched onto the auxiliary member 62 with copper foil or other suitable material. The copper foil of the circuit pattern 72 may have a thin layer of material plated or otherwise disposed thereon in order to prevent oxidation of the foil. For example, the copper foil may be coated with a thin layer of a protective lubricant.

Figure 7:
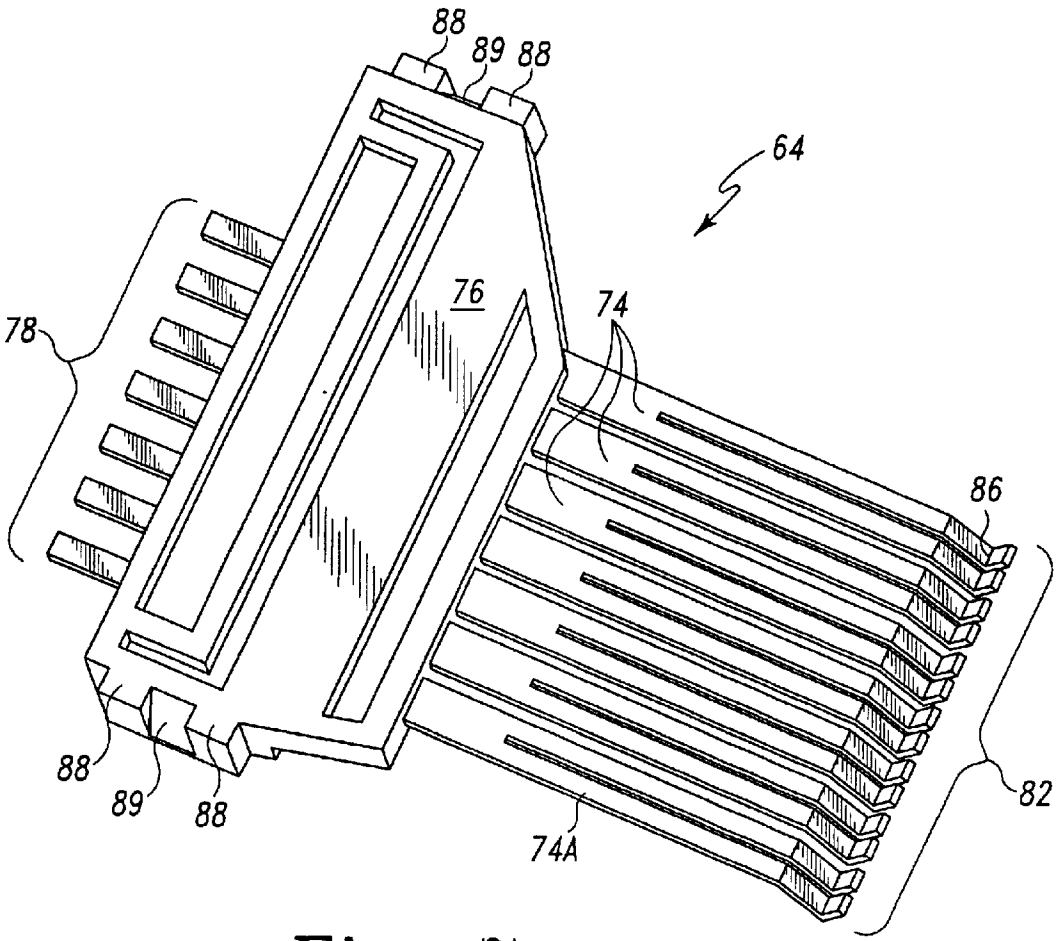
FIG. 7 is a perspective view of the auxiliary wafer assembly of the appliance timer of FIG. 4.
Figure 8:
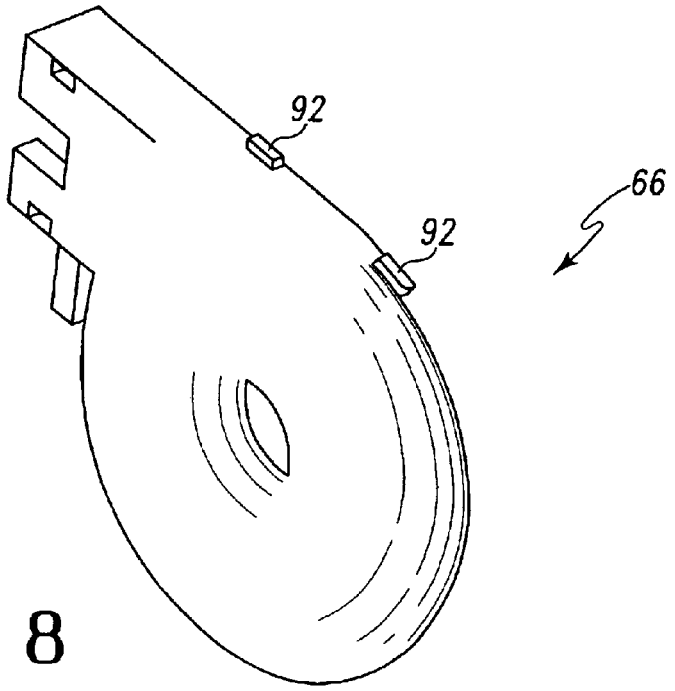
FIG. 8 is a perspective view showing the exterior surface of the auxiliary cover of the appliance timer of FIG. 4.
Figure 9:
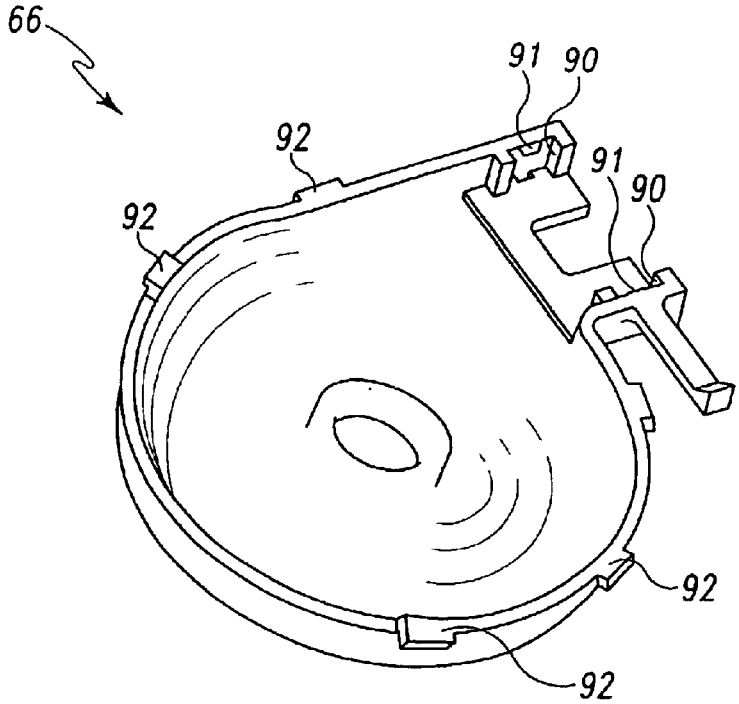
FIG. 9 is a view similar to FIG. 8, but showing the interior surface of the auxiliary cover of the appliance timer of FIG. 4.

As shown in FIG. 7, the auxiliary wafer assembly 64 includes a number of electrically conductive blades or arms 74, and an auxiliary base or wafer 76. The conductive arms 74 have first and second ends 78 and 82, respectively, and are made of a suitable electrically conductive material such as copper. The conductive arms 74 may be secured to the auxiliary wafer 76 in a number of different ways. For example, the conductive arms 74 may be insert molded into the auxiliary wafer 76. The second end 82 of each of the conductive arms 74 is formed to define a contact follower 86. As shown in FIG. 7, the second end 82 of each of the conductive arms 74 is bifurcated to reduce noise generation during operation. The conductive arms 74 are mechanically biased against the auxiliary member 62 such that each of the contact followers 86 contacts the circuit pattern 72 on the front side 73 of the auxiliary member 62 as the auxiliary member 62 rotates with the camstack 24. In this manner, position signals indicative of the rotational position of the auxiliary member 62 and camstack 24 within the appliance timer 12 are generated and transmitted from the contact followers 86 to the processor 11.

According to an exemplary embodiment, the auxiliary wafer assembly 64 includes seven conductive arms 74. One of these arms 74A is electrically connected to the voltage source 13 (see FIG. 4) and provides electrical power that enables operation of the auxiliary wafer assembly 64. In particular, the voltage source 13 supplies conductive arm 74A with a predetermined voltage signal (e.g., 5 millivolts) at its first end 78. This voltage signal is transferred to the second end 82 of the arm 74A, and applied to the circuit pattern 72 on the auxiliary member 62 via the arm's 74A contact follower 86. Each of the remaining arms 74 receives the voltage signal at the second end 82 via its contact follower 86 and transmits the received voltage signal to the first end 78 when its respective second end 82 is electrically coupled to the second end 82 of the conductive arm 74A via the circuit pattern 72 of the auxiliary member 62. The signals present at the first end 78 of the remaining conductive arms 74 represent the rotational position of the auxiliary member 62 and the camstack 24.

Given that the exemplary embodiment uses six of the conductive arms 74 to provide position signals to the processor 11, the auxiliary wafer assembly 64 is capable of providing the processor 11 with up to 64 different digital values (i.e., $2^6$=64). Each of these values may correspond to a different rotational position of the auxiliary member 62 and camstack 24, and specific operations of the appliance 10 may be performed during certain rotational intervals. For example, a rinse operation of the appliance 10 may begin at position seven and end at position eleven (i.e., turn on water at position seven, and off at position eleven). Clearly, a different number of conductive arms 74 may be employed as a matter of design choice. If, for example, a fewer number of arms 74 are used, a fewer number of rotational positions of the auxiliary member 62 and camstack 24 may be detected. Conversely, if a greater number of arms 74 are used, a greater number of rotational positions of the auxiliary member 62 and camstack 24 may be detected.

The auxiliary cover 66 aligns the conductive arms 74 relative to the circuit pattern 72. In particular, the auxiliary wafer 76 has a pair of locating members or tabs 88 defined therein, whereas the auxiliary cover 66 has a pair of locating members or notches 90 defined therein. Moreover, the locating tabs 88 are snap fit or otherwise secured within the locating notches 90. In particular, each of the locating tabs 88 of the auxiliary wafer 76 has a ramped cavity 89 defined therein, whereas the auxiliary cover 66 has a pair of locking tabs 91 defined therein. As the locating tabs 88 are advanced into the locating notches 90, the locking tabs 91 cooperate with the ramped cavities 89 so as to snap fit the auxiliary wafer 76 to the auxiliary cover 66.

Thereafter, a number of attaching tabs 92 defined in the auxiliary cover 66 may be snap fit or otherwise secured within a corresponding number of attachment slots 94 (see FIG. 5) defined in the side plate 18 thereby securing the auxiliary cover 66 and hence the auxiliary wafer assembly 64 to the side plate 18. It should be appreciated that the position of (1) the locating tabs 88 relative to the locating notches 90, and (2) the attaching tabs 92 relative to their respective attachment slots 94 is predetermined such that when the auxiliary assembly 26 is assembled (i.e., secured to the housing of the appliance timer 12), each of the conductive arms 74 is aligned in its respective predetermined position in order to be accurately located relative to the circuit pattern 72 as it is rotated thereunder. While the aforementioned locating configuration has numerous advantages associated therewith, certain of these advantages may be achieved with other locating configurations. For example, a number of locating notches may be defined in the auxiliary wafer 76 with a corresponding number of locating tabs defined in the auxiliary cover 66 thereby allowing the auxiliary wafer assembly 64 to be aligned with the auxiliary member 62 when the auxiliary cover 66 and hence the auxiliary wafer assembly 64 are secured to the side plate 18.

Figure 10:
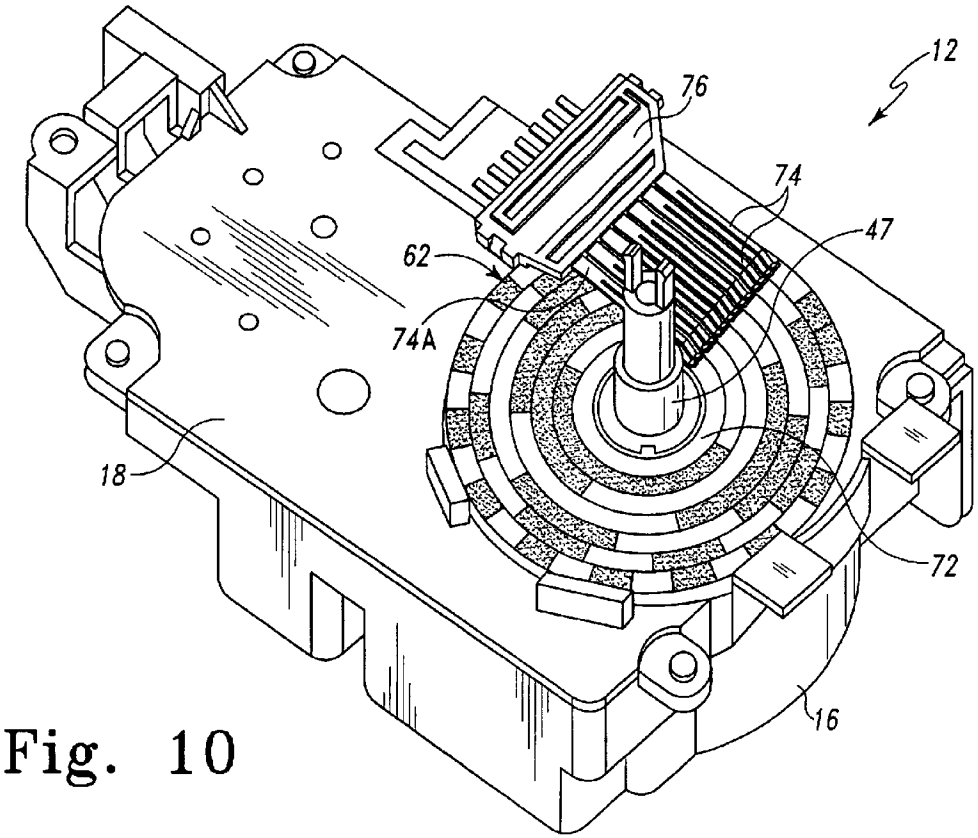
FIG. 10 is a perspective view showing a first operational state of the appliance timer of FIG. 4.
Figure 11:
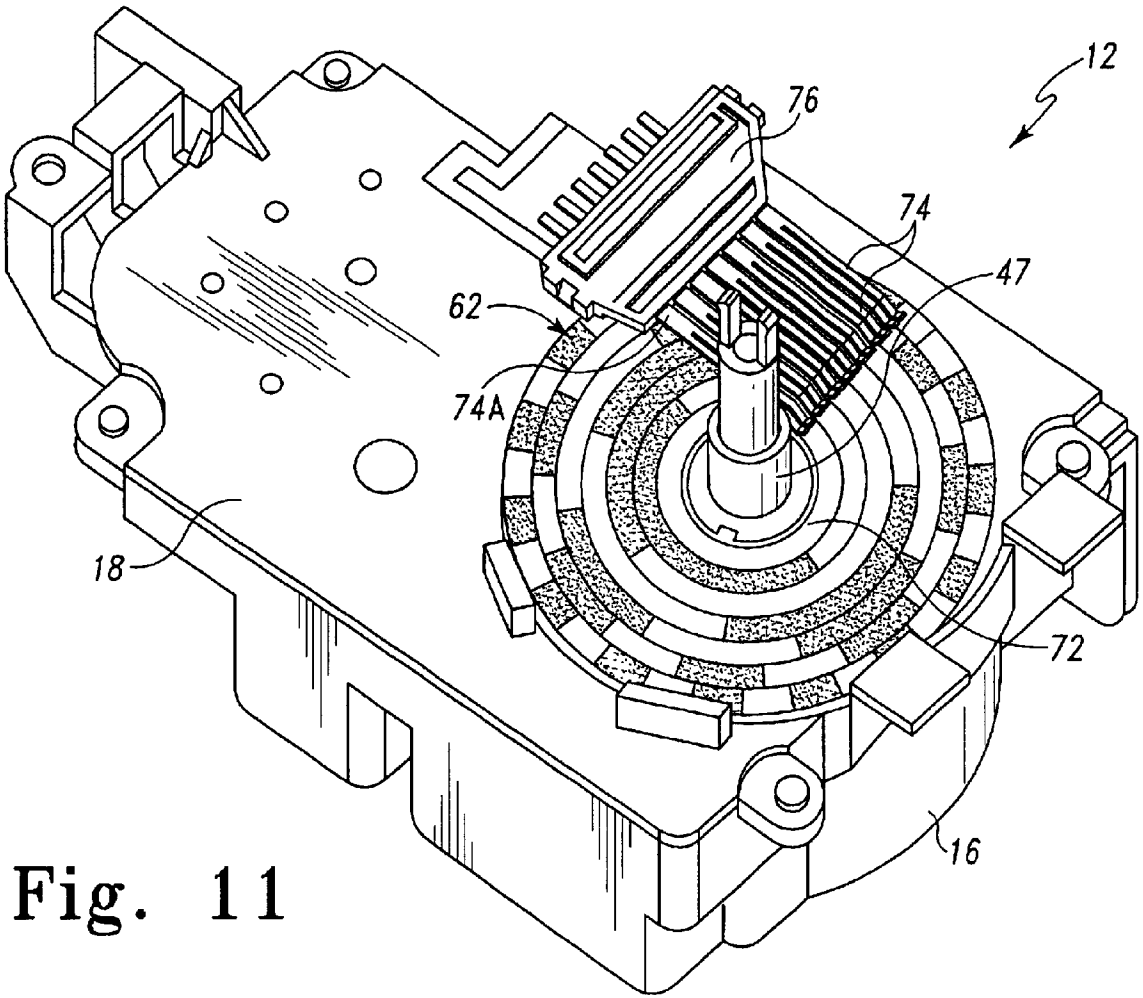
FIG. 11 is a perspective view showing a second operational state of the appliance timer of FIG. 4.

Referring now to FIGS. 10 and 11, further details regarding operation of the first embodiment of the appliance timer 12 are provided. In particular, FIG. 10 shows the auxiliary member 62 and camstack 24 in a first rotational position, and FIG. 11 shows the auxiliary member 62 and camstack in a second rotational position. Accordingly, FIGS. 10 and 11 represent first and second operational states of the first embodiment of the appliance timer 12, respectively.

As shown in FIG. 10, when the auxiliary member 62 and camstack 24 are in the first rotational position, the conductive arm 74A receives a predetermined voltage signal from the voltage source 13 and applies the same to the circuit pattern 72 on the surface of the auxiliary member 62. The voltage signal propagates through the circuit pattern 72 along the surface of the auxiliary member 62 and may be received by the remaining conductive arms 74 depending upon their position upon the circuit pattern 72.

In FIGS. 10 and 11, the unshaded regions of the circuit pattern 72 represent conductive regions where electrical current flows, and the shaded regions represent non-conductive regions where electrical current does not flow. Accordingly, in the rotational position represented in FIG. 10, the voltage signal applied to the circuit pattern 72 by the conductive arm 74A causes all of the remaining conductive arms 74 except one to receive the voltage signal, which according to an embodiment, represents a logic high signal (i.e., "1"). More specifically, in the rotational position represented in FIG. 10, the remaining conductive arms 74 (starting and extending from the conductive arm 74A) receive logic signals of "1," "1," "1," "1," "0," "1." These logic signals represent position signals, and are transferred along the lengths of the remaining arms 74 and provided to the processor 11.

The processor 11 receives and processes the position signals to thereby identify the rotational position of the auxiliary member 62 and camstack 24. Based on the identified rotational position, the processor 11 generates control signals which are then used to control one or more of the second machine components 19 (see FIG. 4). For example, the position signals generated from the rotational position shown in FIG. 10 may represent the start of an agitation cycle in a clothes washer. In this case, the processor 11 provides control signals to the second machine components 19. The control signals cause one of the second machine components 19 to switch on and thereby receive a voltage signal from the voltage source 13, thus commencing the agitation cycle.

Referring now to FIG. 11, a second rotational position of the auxiliary member 62 and camstack 24 is represented. In particular, the second rotational position results from a clockwise rotation of the auxiliary member 62 and camstack 24 relative to the first rotational position of FIG. 10. In the rotational position shown in FIG. 11, the voltage signal applied to the circuit pattern 72 by the conductive arm 74A causes all of the remaining arms 74 to receive the voltage signal since all of the remaining arms 74 are in contact with conductive regions of the circuit pattern 72. Accordingly, in the rotational position represented in FIG. 11, the remaining conductive arms 74 receive logic signals (i.e., position signals) of "1," "1," "1," "1," "1," "1," and provide the same to the processor 11.

The processor 11 receives and processes the position signals to thereby identify the rotational position of the auxiliary member 62 and camstack 24. The processor 11 then generates control signals based on the identified rotational position, and provides the control signals to the second machine components 19 (see FIG. 4). For example, the position signals generated from the rotational position shown in FIG. 11 may represent the end of the agitation cycle, and the start of a spinning cycle in a clothes washer. In this case, the processor 11 provides control signals to the second machine components 19 and thereby causes one of the second machine components 19 to switch off. This prevents such machine component from receiving a voltage signal from the voltage source 13, thus terminating the agitation cycle. Further, providing such control signals also causes another one of the second machine components 19 to switch on and receive a voltage signal from the voltage source 13, whereby the spinning cycle is commenced.

Figure 12:
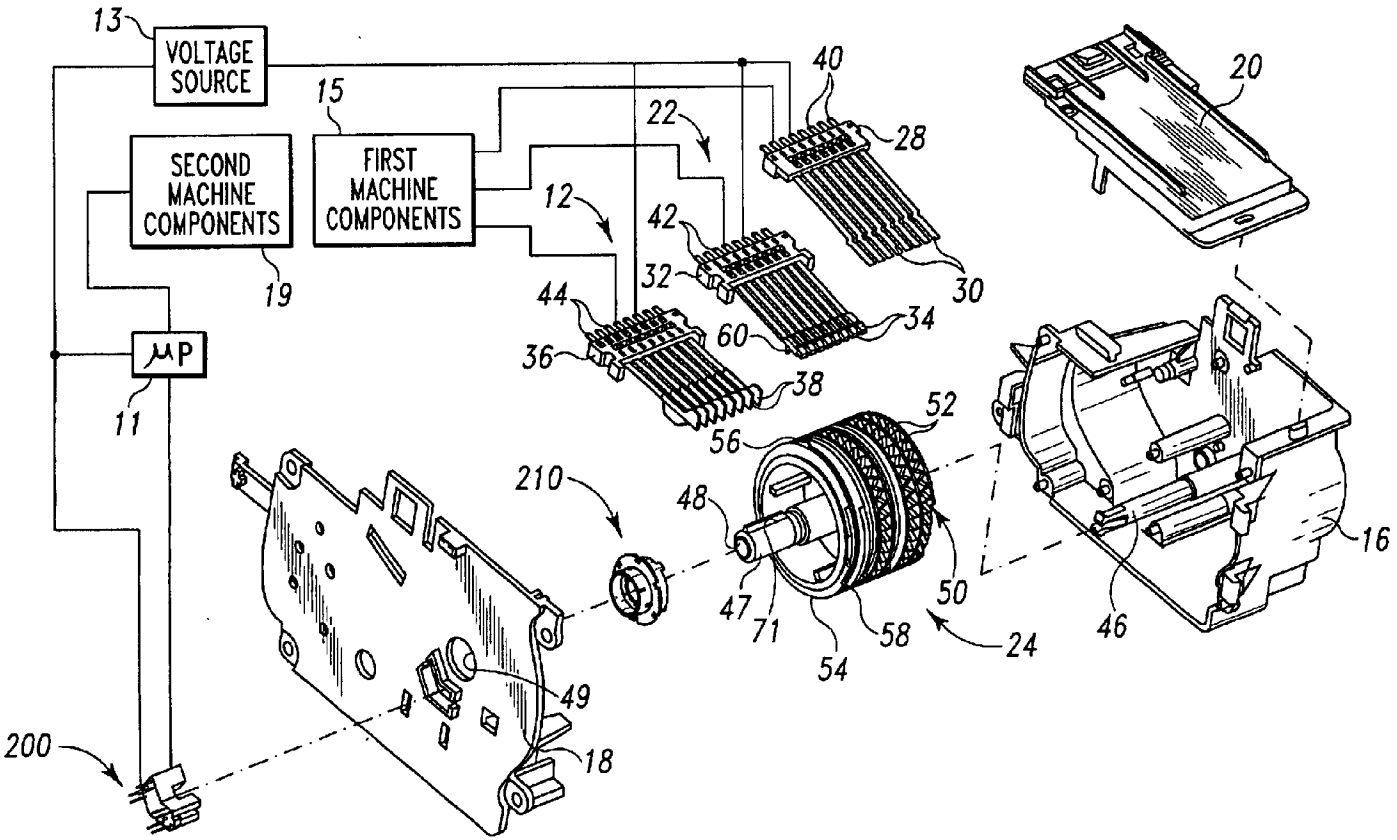
FIG. 12 is an exploded perspective view of a second embodiment of the appliance timer of FIG. 2 (note that a number of components associated with the appliance timer have been removed for clarity of description)
Figure 13:
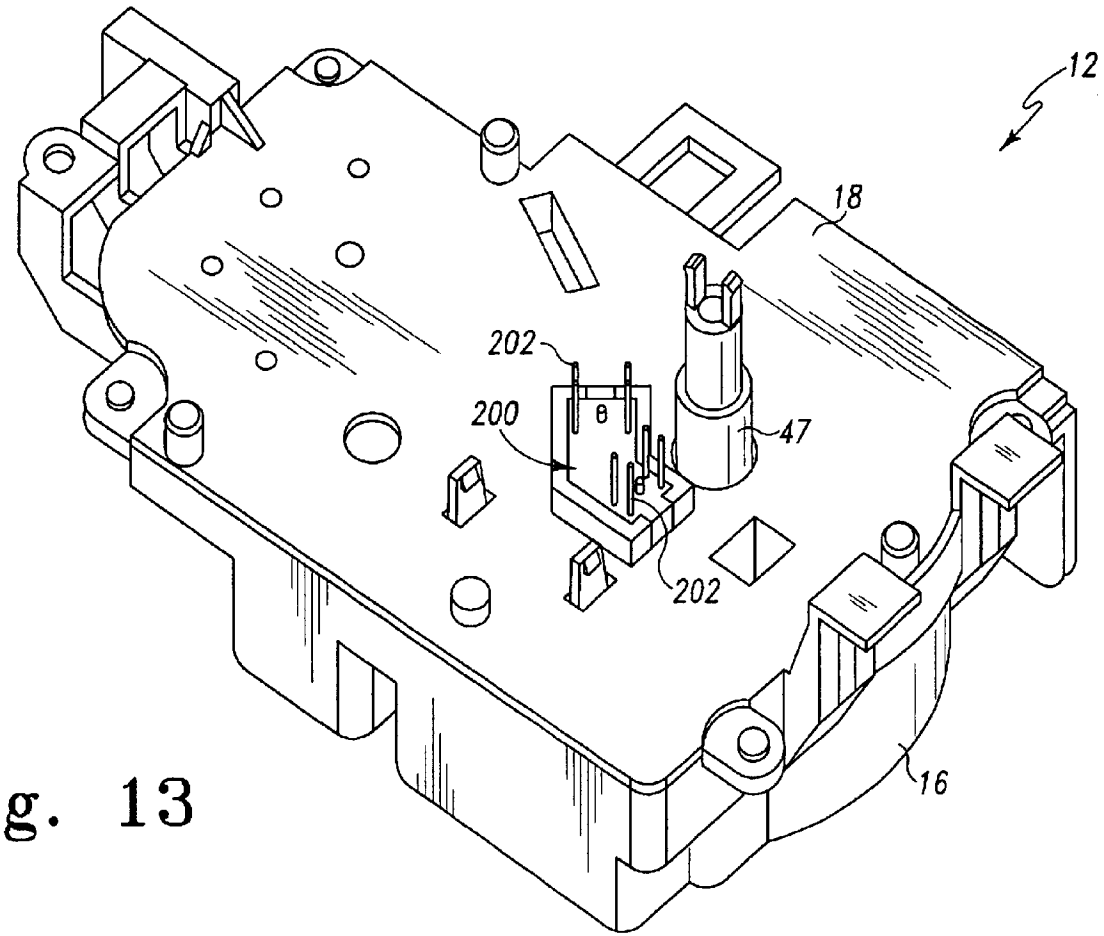
FIG. 13 is a perspective view of the appliance timer of FIG. 12 in an assembled state.
Figure 14:
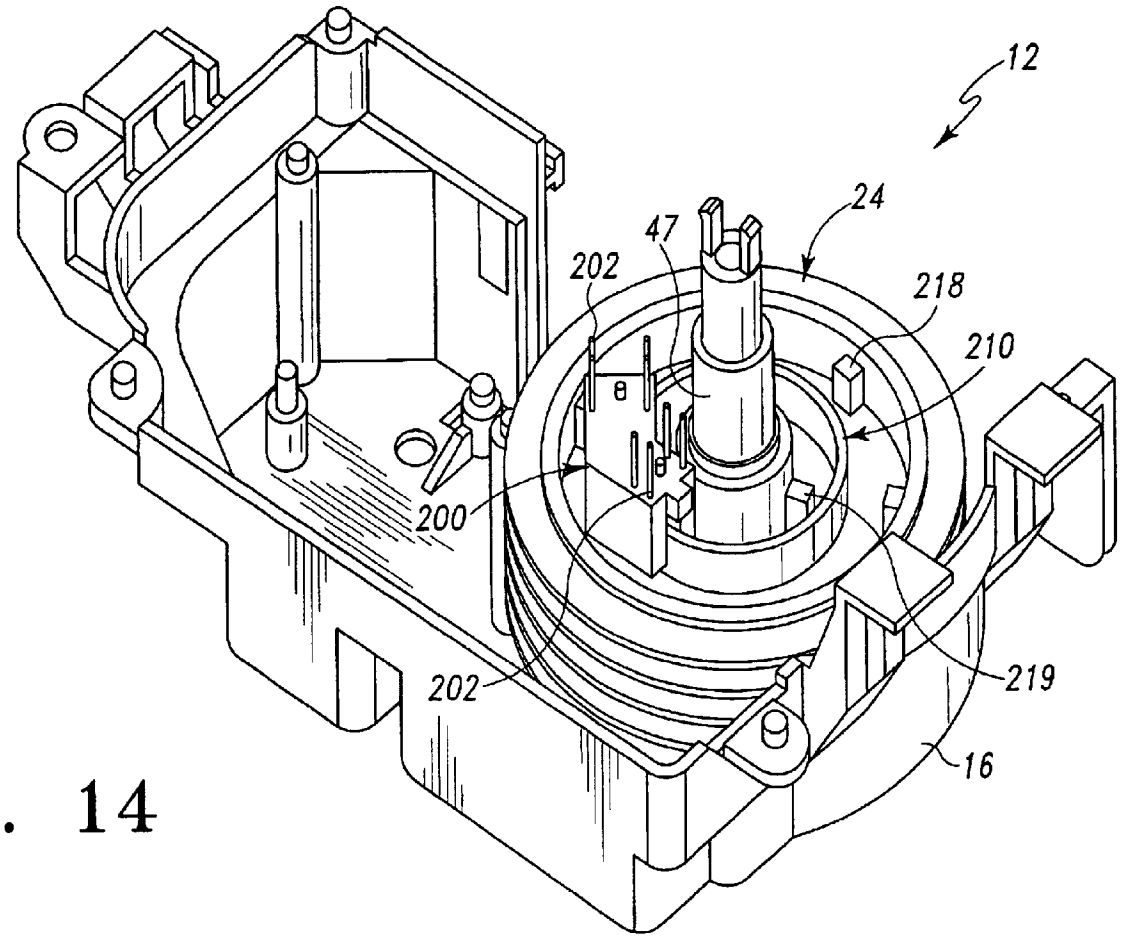
FIG. 14 is a perspective view of the appliance timer of FIG. 12 with the side plate and other components removed for clarity of viewing.

Referring to FIGS. 12 through 16, a second embodiment of the appliance timer 12 of FIG. 2 will now be described. As shown in FIG. 12, the second embodiment of the appliance timer 12 includes a number of components that are the same as or similar to components included in the first embodiment of the appliance timer 12 of FIG. 4. For example, like the first embodiment, the second embodiment of the appliance timer 12 also includes, among other things, a housing member 16, a side plate 18, a top plate 20, a switch block 22, a camstack 24, a processor 11, a voltage source 13, and first and second machine components 15 and 19. Accordingly, for clarity of description, these common components will not be described again, except as they may relate to new aspects of the invention associated with the second embodiment of the appliance timer 12.

In particular, the second embodiment of the appliance timer 12 provides an alternative mechanism for detecting the rotational position of the camstack 24, and providing position signals indicative of the detected position to the processor 11. More specifically, the second embodiment of the appliance timer 12 uses an optical sensing device 200 to generate position signals representative of the rotational position of the camstack 24. As will be described later herein, generation of the position signals by the optical sensing device 200 is facilitated by an auxiliary member 210.

Figure 16:
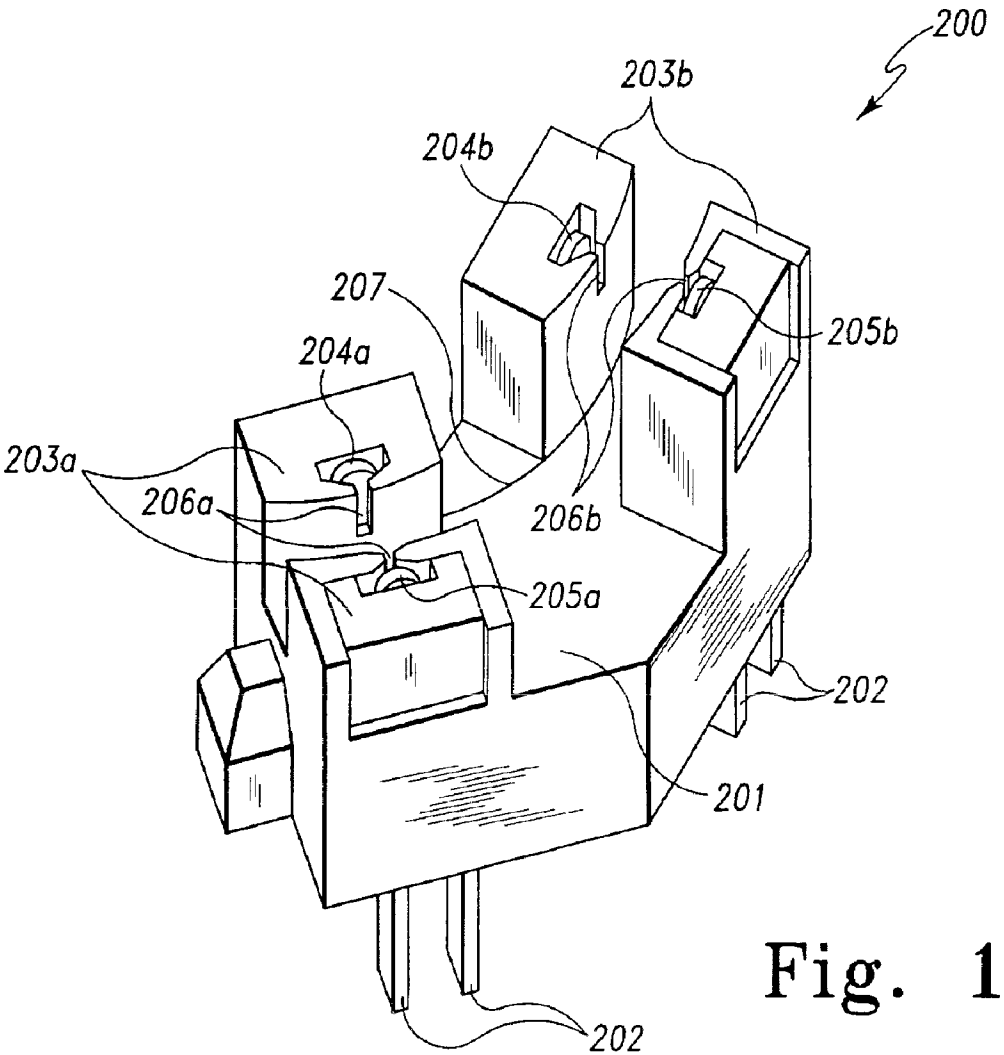
FIG. 16 is a perspective view of the optical sensing device of the appliance timer of FIG. 12.

As shown in FIG. 16, the optical sensing device 200 includes a main body 201. Electrically conductive terminals or leads 202 extend outwardly from one end of the main body 201. The leads 202 include inputs terminals for receiving electrical power from the voltage source 13, and further include output terminals for providing position signals to the processor 11. The leads 202 may be connected to a plug and cable or other suitable means which facilitates power delivery from the voltage source 13 to the device 200, and position signal transmission from the device 200 to the processor 11 (see FIG. 12). A first pair of optical elements 203*a* and a second pair of optical elements 203*b* extend outwardly from another side of the main body 201. According to an exemplary embodiment, the first pair of optical elements 203*a* is shorter in height than the second pair of optical elements 203*b*. However, a common height could also be used. Each pair of the optical elements 203*a* and 203*b* includes an optical transmitter and a corresponding optical receiver. In particular, an optical transmitter 204*a* and an optical receiver 205*a* are included in the first pair of optical elements 203*a*. Similarly, an optical transmitter 204*b* and an optical receiver 205*b* are included in the second pair of optical elements 203*b*. Slits 206*a* and 206*b* are provided in each of the optical elements 203*a* and 203*b* so that light transmitted from the optical transmitters 204*a* and 204*b* can be detected by the optical receivers 205*a* and 205*b*, respectively. A channel 207 defining an arcuate path is formed between the optical transmitters 204*a* and 204*b* and the optical receivers 205*a* and 205*b* to accommodate passage of the auxiliary member 210 as it rotates with the camstack 24.

According to an exemplary embodiment, each of the optical transmitters 204*a* and 204*b* continuously transmits a beam of light when the optical sensing device 200 receives electrical power from the voltage source 13. The corresponding optical receivers 205*a* and 205*b* await detection of this transmitted light. In this manner, each pair of the optical elements 203*a* and 203*b* generates a position signal, namely either a logic high signal or a logic low signal, in dependence upon whether the light transmitted from the optical transmitters 204*a* and 204*b* is detected by the optical receivers 205*a* and 205*b*, respectively. According to one embodiment, a logic high signal is generated by a pair of the optical elements 203*a* or 203*b* only when light transmitted from an optical transmitter 204*a* or 204*b* is detected by a corresponding optical receiver 205*a* or 205*b*, respectively. Accordingly, when light is not detected by a corresponding optical receiver 205*a* or 205*b*, a logic low signal is generated. According to another embodiment, however, a logic low signal is generated by a pair of the optical elements 203*a* or 203*b* only when light transmitted from an optical transmitter 204*a* or 204*b* is detected by a corresponding optical receiver 205*a* or 205*b*, respectively. Accordingly, when light is not detected by a corresponding optical receiver 205*a* or 205*b*, a logic high signal is generated. The aforementioned use of logic signals is simply a matter of design choice.

Figure 15:
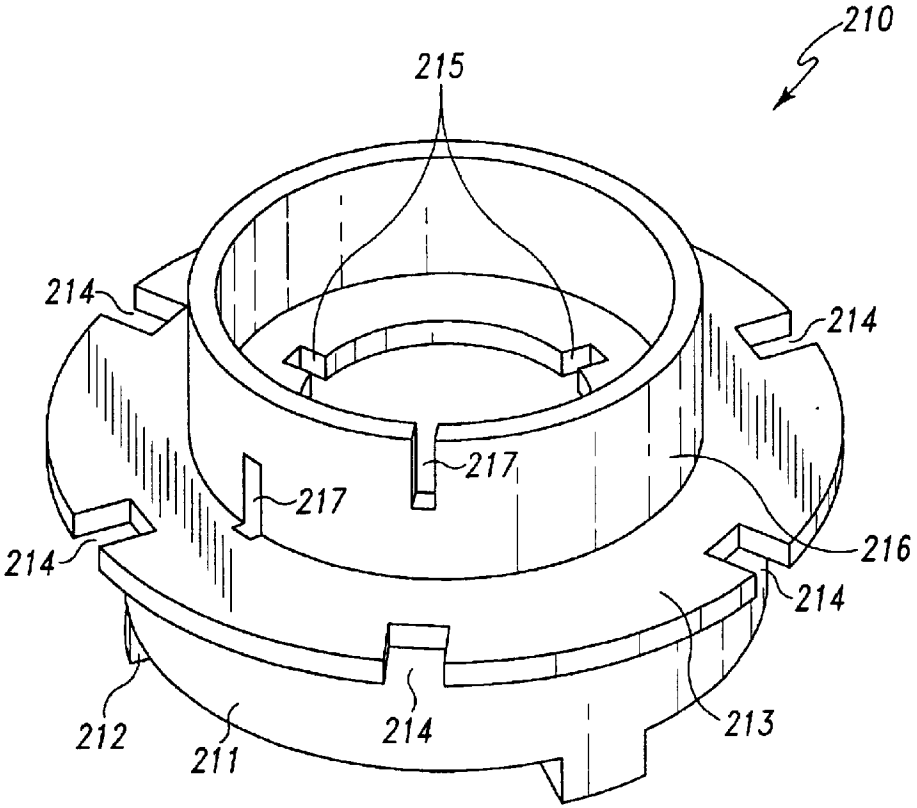
FIG. 15 is a perspective view of the auxiliary member of the appliance timer of FIG. 12.

Further details regarding the auxiliary member 210 are shown in FIG. 15. In particular, the auxiliary member 210 includes a first lateral portion 211, an intermediate portion 213 and a second lateral portion 216. The first lateral portion 211 preferably possesses a circular, ring-like shape, although other shapes may be used. A number of protrusions 212 extend outwardly from the first lateral portion 211 to facilitate installation of the auxiliary member 210 into the camstack 24. In particular, the protrusions 212 may be inserted into recesses (not shown) formed in the camstack 24.

The intermediate portion 213 is interposed between the first lateral portion 211 and the second lateral portion 216. A number of slots 214 are formed at spaced-apart angular intervals in an outer periphery of the intermediate portion 213. A number of slots 215 are also formed at spaced-apart angular intervals in an inner periphery of the intermediate portion 213. The slots 214 and 215 facilitate installation of the auxiliary member 210 into the camstack 24. In particular, the slots 214 conform to notches 218 in the camstack 24, and the slots 215 conform to notches 219 in the camstack 24 (see FIG. 14). Accordingly, by aligning the slots 214 and 215 with the notches 218 and 219, respectively, the auxiliary member 210 may be properly installed in the camstack 24. Note that the slots 214 and 215 and the notches 218 and 219 operate in conjunction with the protrusions 212 of the first lateral portion 211 to ensure that the auxiliary member 210 is properly installed in the camstack 24. In this manner, the properly installed auxiliary member 210 is secured to, and will rotate with the camstack 24 during operation of the appliance timer 12. Except as modified by the slots 214 and 215, the intermediate portion 213 possesses a circular, ring-like shape, although other shapes may be used.

The second lateral portion 216 is positioned adjacent to the intermediate portion 213, and preferably possesses a circular, ring-like shape. A number of apertures 217 are formed within the second lateral portion 216 to facilitate an optical sensing operation by the optical sensing device 200, as will be described later herein. When the auxiliary member 210 is secured to the camstack 24, the second lateral portion 216 extends outwardly to cooperate with the optical sensing device 200. In particular, the optical sensing device 200 is positioned relative to the auxiliary member 210 such that the second lateral portion 216 is positioned within the channel 207 of the optical sensing device 200. In this manner, when the auxiliary member 210 rotates with the camstack 24 during operation of the appliance timer 12, the apertures 217 formed within the second lateral portion 216 of the auxiliary member 210 cause the optical elements 203*a* and 203*b* of the optical sensing device 200 to generate position signals indicative of the rotational position of the camstack 24.

More specifically, when the auxiliary member 210 rotates with the camstack 24 during operation of the appliance timer 12, the apertures 217 formed within the second lateral portion 216 of the auxiliary member 210 are detected by the optical sensing device 200 as light passes through the apertures 217 from the optical transmitters 204*a* and 204*b* to the optical receivers 205*a* and 205*b*, respectively. Each of the apertures 217 corresponds to a predetermined rotational position of the auxiliary member 210 and camstack 24 with respect to the optical sensing device 200. Therefore, according to an exemplary embodiment, when one pair of the optical elements 203*a* or 203*b* generates a logic high signal, this indicates that one of the apertures 217 has been detected.

In the exemplary embodiment shown in the drawings, the optical sensing device 200 includes two pairs of optical elements, namely 203*a* and 203*b*, with the elements 203*b* having a vertical height greater than the elements 203*a* (see FIG. 16). Moreover, the auxiliary member 210 includes two apertures 217, one being formed at the top of the second lateral portion 216 and the other being formed at the bottom of the second lateral portion 216 (see FIG. 15). Accordingly, when the auxiliary member 210 and camstack 24 rotate during operation of the appliance timer 12, the optical elements 203*a* detect the aperture 217 formed at the top of the second lateral portion 216, while the optical elements 203*b* detect the aperture 217 formed at the bottom of the second lateral portion 216.

For example, when the auxiliary member 210 and camstack 24 rotate during operation of the appliance timer 12, the optical elements 203*b* may first detect the aperture 217 formed at the bottom of the second lateral portion 216. In response to this detection, a logic high signal is generated by the optical elements 203*b*. This logic (i.e., position) signal is provided to the processor 11 which processes the position signal to thereby identify the rotational position of the auxiliary member 210 and camstack 24. The processor 11 then generates control signals based on the identified rotational position, and provides the control signals to the second machine components 19 (see FIG. 12). The control signals cause one of the second machine components 19 to switch on and thereby receive a voltage signal from the voltage source 13, thus commencing, for example, a water filling operation of a clothes washer.

As the auxiliary member 210 and camstack 24 continue to rotate during operation of the appliance timer 12, the optical elements 203*a* may detect the aperture 217 formed at the top of the second lateral portion 216. In response to this detection, a logic high signal is generated by the optical elements 203*a*. This logic (i.e., position) signal is provided to the processor 11 which processes the position signal to thereby identify the rotational position of the auxiliary member 210 and camstack 24. The processor 11 then generates control signals based on the identified rotational position, and provides the control signals to the second machine components 19 (see FIG. 12). The control signals cause one of the second machine components 19 to switch off, thereby preventing such machine component from receiving a voltage signal from the voltage source 13, thus terminating the water filling operation. Further, providing such control signals also causes another one of the second machine components 19 to switch on and receive a voltage signal from the voltage source 13, whereby another operation such as an agitation cycle is commenced.

In the aforementioned manner, the optical sensing device 200 detects the apertures 217 formed within the auxiliary member 210, and thereby enables corresponding rotational positions of the auxiliary member 210 and camstack 24 to be identified by the processor 11. While the disclosed embodiment detects only two rotational positions of the auxiliary member 210 and camstack 24 (and thereby enables at least two additional operations of the appliance 10), it is contemplated that a fewer or larger number of rotational positions may be detected by altering the number of apertures 217 formed within the auxiliary member 210 and/or altering the number of optical elements included in the optical sensing device 200.

According to an alternative embodiment, the processor 11 may perform a counting operation based on the position signals received from the optical sensing device 200, and enable performance of specific operations in dependence upon the counting operation. For example, assuming the auxiliary member 210 includes four such apertures 217, the following type of control scheme may be employed.

| Aperture Detected | Water Filling | Agitation | Water Draining | Spinning |
|---|---|---|---|---|
| 1 | On | Off | Off | Off |
| 2 | Off | On | Off | Off |
| 3 | Off | Off | On | Off |
| 4 | Off | Off | Off | On |

As indicated in the foregoing table, when the optical sensing device 200 detects the first aperture 217, this causes the processor 11 to begin an internal count process (e.g., starting with a count value of 1), and generate control signals that start a water filling operation of a clothes washer. As the auxiliary member 210 and camstack 24 rotate, the optical sensing device 200 detects the second aperture 217. Detection of the second aperture 217 causes the processor 11 to increment the count value (e.g., to 2) and generate control signals that cause the water filling operation to end and an agitation cycle to begin. As the auxiliary member 210 and camstack 24 continue to rotate, the optical sensing device 200 detects the third aperture 217. Detection of the third aperture 217 causes the processor 11 to again increment the count value (e.g., to 3) and generate control signals that cause the agitation cycle to end and a water draining operation to begin. Finally, as the auxiliary member 210 and camstack 24 continue to rotate, the optical sensing device 200 detects the fourth aperture 217. Detection of the fourth aperture 217 causes the processor 11 to again increment the count value (e.g., to 4) and generate control signals that cause the water draining operation to end and a spinning cycle to begin. Of course, other types of control schemes may be employed using the same or similar principles.

Figure 17:
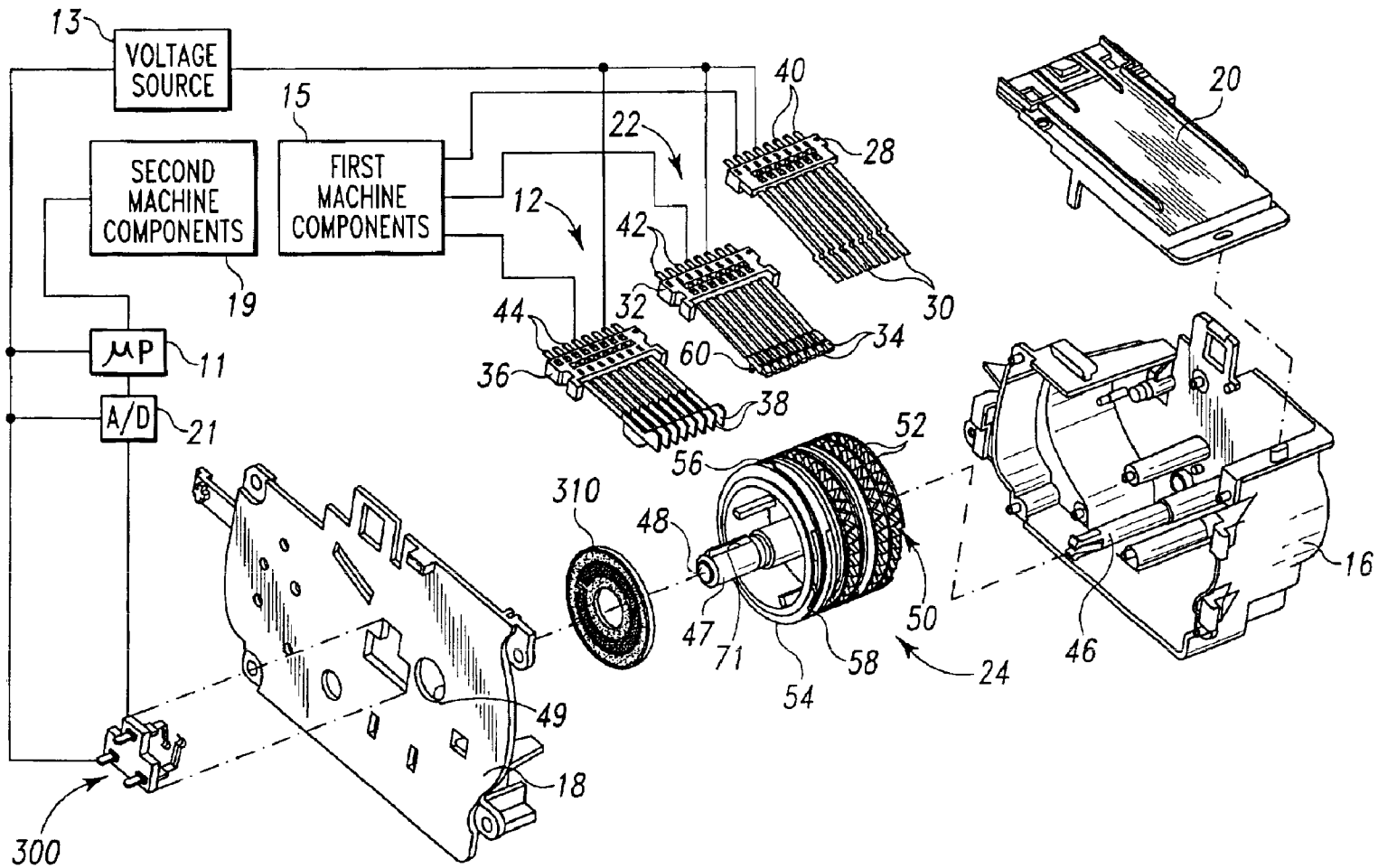
FIG. 17 is an exploded perspective view of a third embodiment of the appliance timer of FIG. 2 (note that a number of components associated with the appliance timer have been removed for clarity of description)
Figure 18:
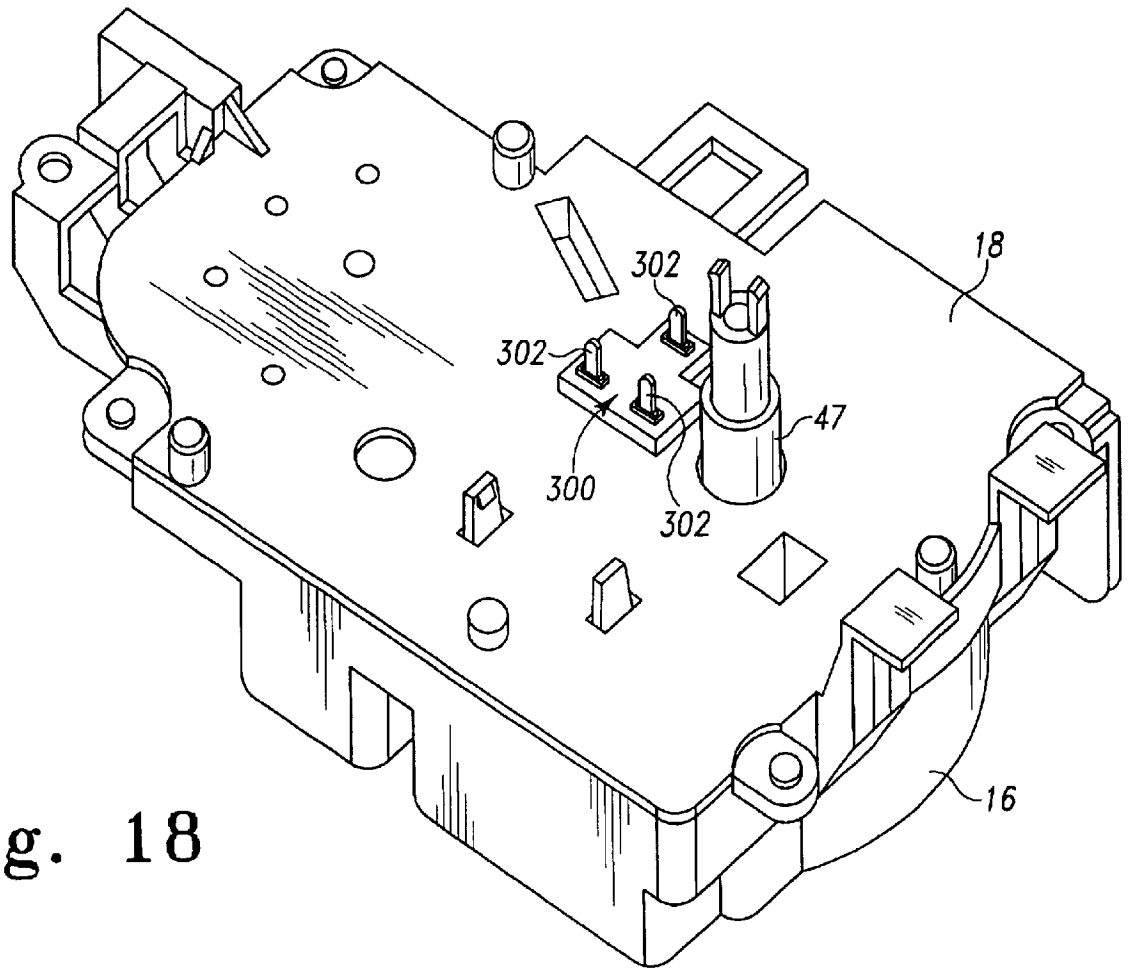
FIG. 18 is a perspective view of the appliance timer of FIG. 17 in an assembled state.

Referring to FIGS. 17 through 23, a third embodiment of the appliance timer 12 of FIG. 2 will now be described. As shown in FIG. 17, the third embodiment of the appliance timer 12 includes a number of components that are the same as or similar to components included in the first and second embodiments of the appliance timer 12. For example, like the first and second embodiments, the third embodiment of the appliance timer 12 also includes a housing member 16, a side plate 18, a top plate 20, a switch block 22, a camstack 24, a processor 11, a voltage source 13, and first and second machine components 15 and 19. Accordingly, for clarity of description, these common components will not be described again, except as they relate to new aspects of the invention associated with the third embodiment of the appliance timer 12.

In particular, the third embodiment of the appliance timer 12 provides yet another alternative mechanism for sensing the rotational position of the camstack 24, and providing position signals indicative of the sensed position to the processor 11. More specifically, the third embodiment of the appliance timer 12 uses a sensing device 300 which generates position signals representative of the sensed rotational positions of the camstack 24. As will be described later herein, the sensing device 300 generates the position signals based on a voltage dividing operation facilitated by yet another auxiliary member 310.

Figure 21:
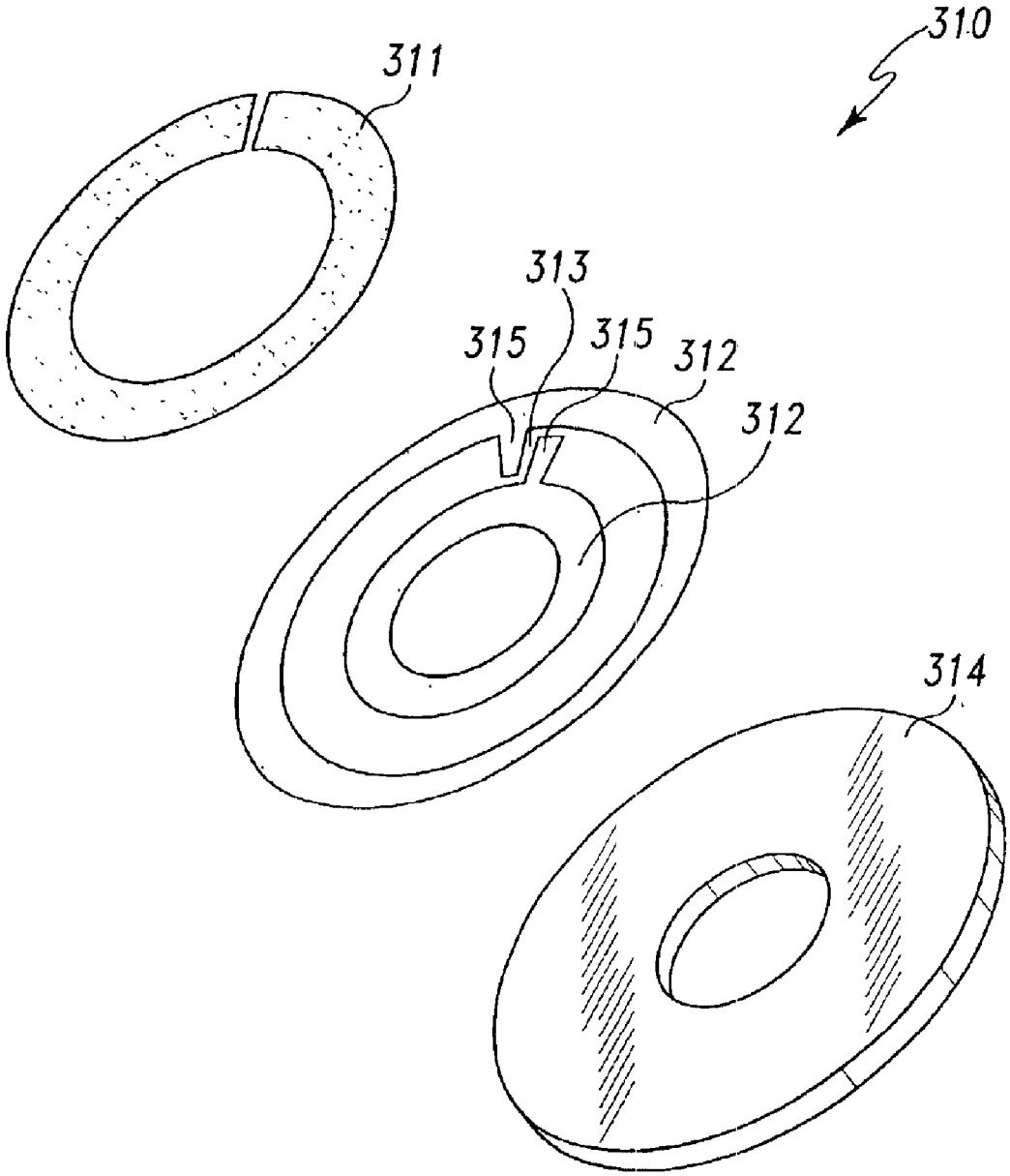
FIG. 21 is an exploded perspective view of the auxiliary member of FIG. 20.
Figure 23:
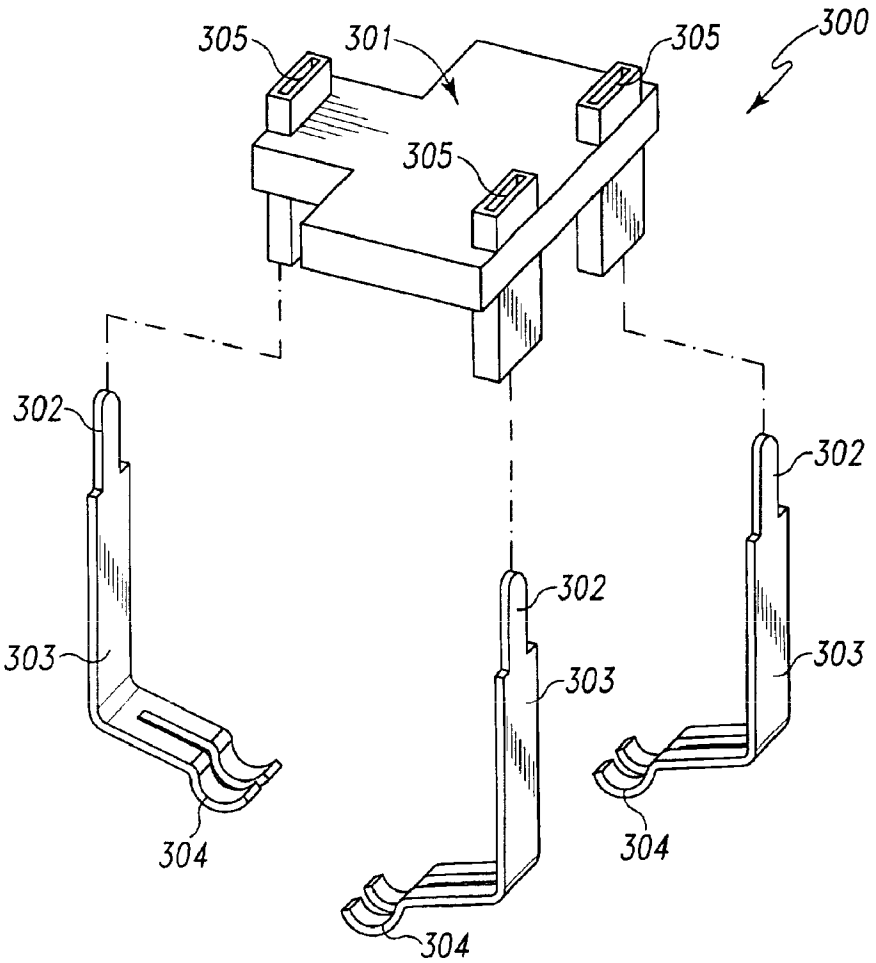
FIG. 23 is an exploded perspective view of the sensing device of FIG. 22.
Figure 22:
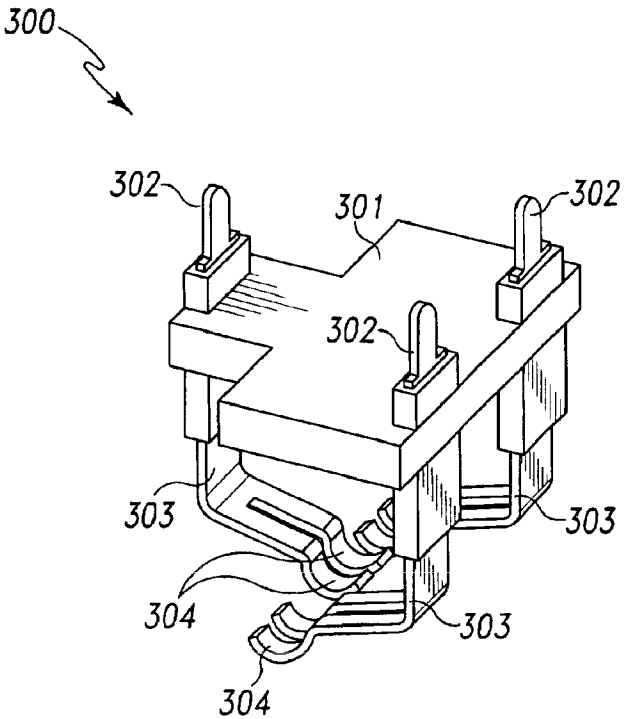
FIG. 22 is a perspective view of the sensing device of the appliance timer of FIG. 17.

As shown in FIGS. 22 and 23, the sensing device 300 includes a main body 301. Electrically conductive terminals or leads 302*a* to 302*c* extend outwardly from one end of the main body 301 (see FIG. 22). The inner lead 302*a* is electrically connected to ground, and the outer lead 302*c* is electrically connected to the voltage source 13 (see FIG. 17) for providing a voltage (e.g., 5 volts) to the auxiliary member 310 (see FIGS. 20 and 21) that is divided to generate the position signals. The center lead 302*b* is an output terminal for receiving the position signals in an analog format, and providing the same to an analog-to-digital (A/D) converter 21 (see FIG. 17). The leads 302*a* to 302*c* may be connected to a plug and cable or other suitable signal transmission means which facilitates power delivery from the voltage source 13 to the sensing device 300, and position signal transmission from the sensing device 300 to the A/D converter 21 and processor 11 (see FIG. 17). Each of the leads 302*a* to 302*c* is part of an electrically conductive arm 303*a* to 303*c*, respectively. Each of the conductive arms 303*a* to 303*c* respectively includes a contact follower 304*a* to 304*c* which contacts the auxiliary member 310 during operation of the appliance timer 12 to enable a voltage dividing operation, as will be described later herein. Ends of the conductive arms 303*a* to 303*c* that include the contact followers 304*a* to 304*c* are bifurcated so as to reduce noise generation. Slots 305*a* to 305*c* are formed in the body 301 of the device 300 to respectively accommodate insertion of the conductive arms 303*a* to 303*c* into the body 301 (see FIG. 23).

Figure 20:
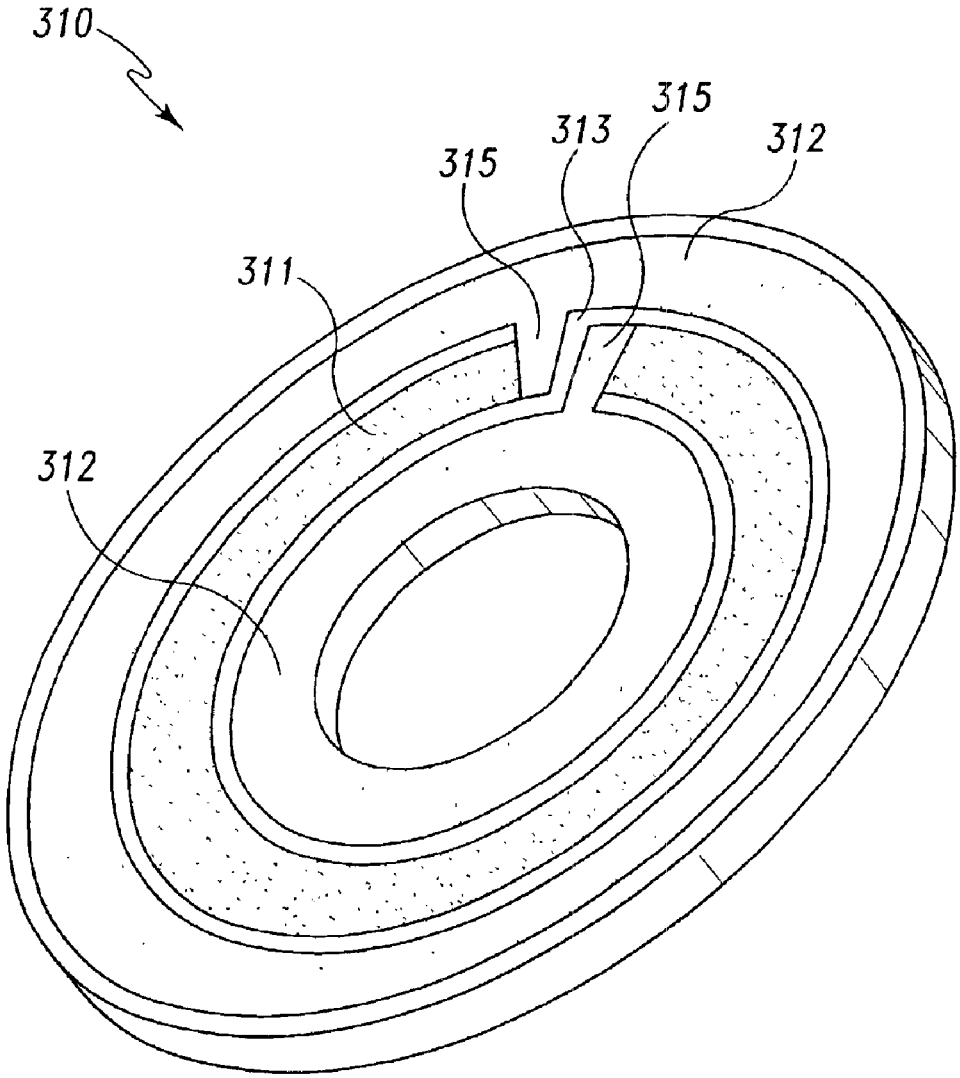
FIG. 20 is a perspective view of the auxiliary member of the appliance timer of FIG. 17.

Further details regarding the auxiliary member 310 are shown in FIGS. 20 and 21. In particular, the auxiliary member 310 includes a main body 314 having a substantially circular, ring-like shape. The main body 314 may be made of a common circuit board material such as epoxy or other nonconductive material. The auxiliary member 310 further includes a resistive strip 311 and two conductive strips 312. The resistive strip 311 may be composed of a coating of an electrically resistive material having a known resistance (e.g., 1K ohms). Each of the conductive strips 312 may be composed of a coating of an electrically conductive material such as silver, palladium or other material. Each of the conductive strips 312 also includes a keying portion or tab 315. An index mark 313 on the main body 314 defines a gap between the keying portions 315 of the two conductive strips 312, and as will be discussed in further detail later herein, may be used to represent a predetermined rotational position of the auxiliary member 310 and camstack 24.

Figure 19:
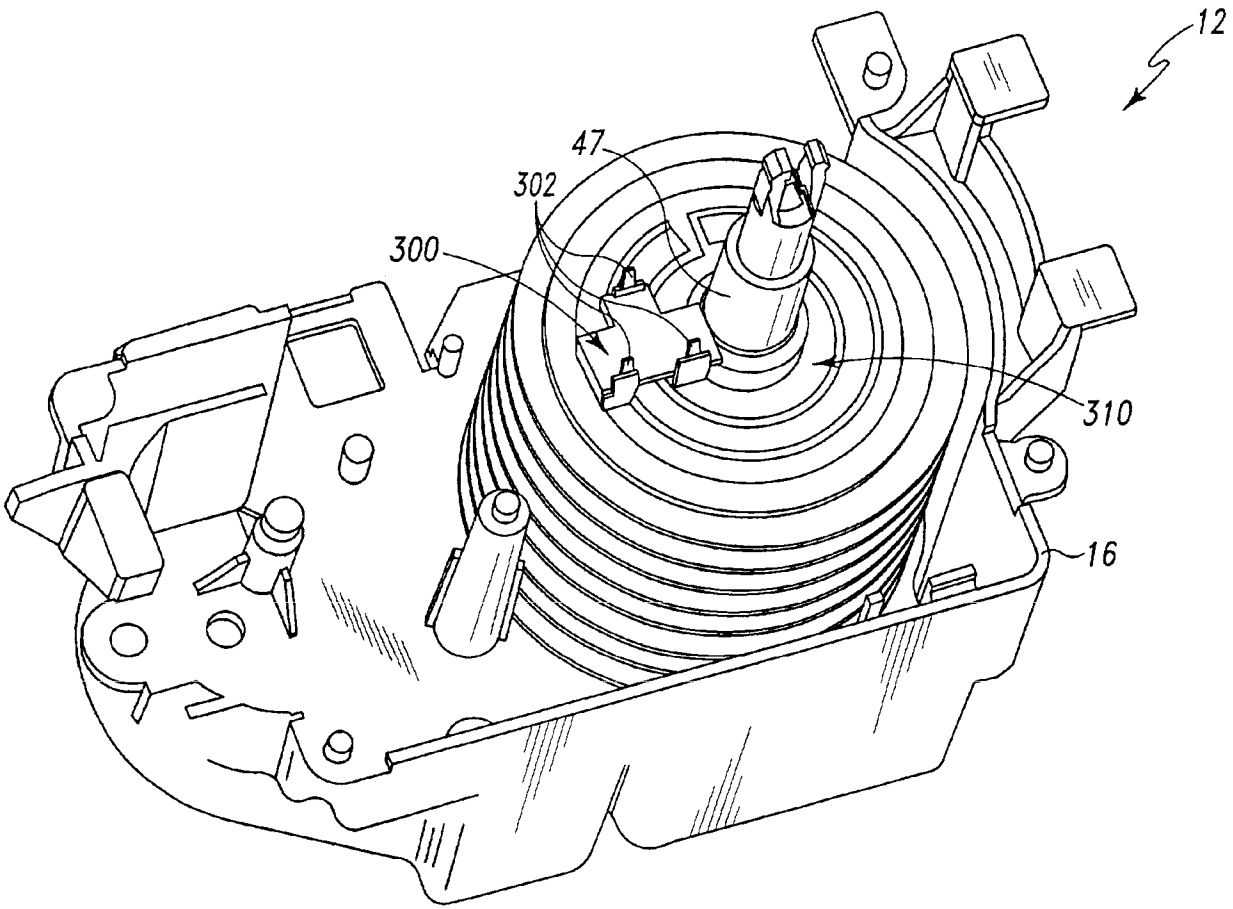
FIG. 19 is a perspective view of the appliance timer of FIG. 17 with the side plate and other components removed for clarity of viewing.

As shown in FIG. 19, the auxiliary member 310 is secured to the hub 47 of the camstack 24. Although not shown in the drawings, the auxiliary member 310 preferably includes a keying member or tab in the main body 314 like the auxiliary member 62 of the first embodiment to ensure that the auxiliary member 310 is non-rotatably secured to the hub 47 of the camstack 24. In this manner, the auxiliary member 301 and camstack 24 rotate together when the appliance timer 12 operates.

The sensing device 300 is positioned adjacent to the auxiliary member 310 such that the contact followers 304*a* to 304*c* of the device 300 are mechanically biased against the resistive strip 311 and the conductive strips 312 of the auxiliary member 310 to enable a voltage dividing operation. In particular, the center contact follower 304*b* engages the resistive strip 311, while the two side or lateral contact followers 304*a* and 304*c* engage the two conductive strips 312. When the appliance timer 12 is assembled, the sensing device 300 is properly maintained in contact with the auxiliary member 310 by a recess within the side plate 18 that conforms to the shape of the device 300 (see FIG. 18).

As the auxiliary member 310 and camstack 24 rotate during operation of the appliance timer 12, the outer contact follower 304*c* applies a voltage to the auxiliary member 310 through the outer conductive strip 312. This voltage is divided by the resistive strip 311. The center contact follower 304*b* engages the resistive strip 311 and provides an output voltage representative of its rotational position along the resistive strip 311, and hence the rotational position of the auxiliary member 310 and camstack 24. Accordingly, as the auxiliary member 310 and camstack 24 rotate, the output voltages received on the center contact follower 304*b* vary in dependence upon the rotational position of the auxiliary member 310 and camstack 24. These received output voltages pass through the center conductive arm 303*b* and are output at the center lead 302*b*.

The position signals provided at the center lead 302*b* are then applied to the A/D converter 21 (see FIG. 17), which digitizes the voltages and provides the resulting digital signals to the processor 11. According to an exemplary embodiment, the A/D converter 21 is separate from the processor 11. However, according to another embodiment, the A/D converter 21 may be included within the processor 11. The processor 11 receives and processes the digital signals provided from the A/D converter 21, and thereby identifies the rotational position of the auxiliary member 310 and camstack 24. The processor 11 then generates control signals based on the identified rotational position, and provides the control signals to the second machine components 19 (see FIG. 17). The control signals cause one of the second machine components 19 to switch on and thereby receive a voltage signal from the voltage source 13, thus commencing an operation such as starting a motor of a clothes washer or other device.

The third embodiment of the appliance timer 12 may begin operation when the contact followers 304*a* to 304*c* of the sensing device 300 are aligned with the index mark 313 of the auxiliary member 310 (see FIGS. 20 to 23). In this position, the two side or lateral contact followers 304*a* and 304*c* of the sensing device 300 are in contact with the two conductive strips 312, and the center contact follower 304*b* is in contact with the index mark 313. This position may correspond to a rotational position of the auxiliary member 310 and camstack 24 where the appliance timer 12 is in an off state, and no appliance operation is being performed.

While the sensing device 300 is in the aforementioned position, a predetermined voltage signal from the voltage source 13 (see FIG. 17) is applied to the auxiliary member 310 via the contact follower 304*c* of the sensing device 300. Assuming for example, the voltage source 13 provides a voltage signal of 5 volts, the voltage on the outer contact follower 304*c* is 5 volts. The inner contact follower 304*a* is coupled to ground, and thus is 0 volts. Also, the voltage on the center contact follower 304*b* is 0 volts, since the index mark 313 is nonconductive. At this point, a user may turn the appliance timer 12 to an on state by slightly rotating the auxiliary member 310 and camstack 24 in a clockwise direction. The on state may, for example, cause the appliance timer 12 to effectuate a series of appliance operations, as will be described below.

In the aforementioned on state, the outer lateral contact follower 304*c* is in contact with the outer conductive strip 312, and the center contact follower 304*b* is in contact with the keying portion 315 of the outer conductive strip 312. The inner lateral contact follower 304*a* is in contact with the inner conductive strip 312, but is separated from the outer conductive strip 312 by the resistive strip 311. Here, assuming that the outer contact follower 304*c* is receiving the 5 volt signal from the voltage source 13, the voltage on both the outer contact follower 304*c* and the center contact follower 304*b* is 5 volts, and the voltage on the inner contact follower 304*a* is 0 volts.

As the appliance timer 12 begins operation, the auxiliary member 310 and camstack 24 may continue rotation in a clockwise direction. As the auxiliary member 310 and camstack 24 rotate in this manner, the two lateral contact followers 304*a* and 304*c* of the sensing device 300 travel along the conductive strips 312, and the center contact follower 304*b* travels along the resistive strip 311, which divides the voltage signal provided from the voltage source 13. Accordingly, as the auxiliary member 310 and camstack 24 continue rotation, the voltage on the center contact follower 304*b* varies based on the rotational position. The table below provides exemplary voltages on the contact followers 304*a* to 304*c* based on the rotational position of the auxiliary member 310 and camstack 24.

| Rotational Position of Auxiliary Member 310 and Camstack 24 | Voltage on Outer Contact Follower 304c | Voltage on Center Contact Follower 304b | Voltage on Inner Contact Follower 304a |
|---|---|---|---|
| 0° | 5 volts | 0 volts | 0 volts |
| 5° | 5 volts | 5 volts | 0 volts |
| 90° | 5 volts | 3.75 volts | 0 volts |
| 180° | 5 volts | 2.5 volts | 0 volts |
| 270° | 5 volts | 1.25 volts | 0 volts |
| 355° | 5 volts | 0 volts | 0 volts |
| 360° | 5 volts | 0 volts | 0 volts |

As indicated above, the voltages on the center contact follower 304*b* varies based on the rotational position of the auxiliary member 310 and camstack 24. The entries at 0° and 360° correspond to the aforementioned off state of the appliance timer 12 where no appliance operation is performed. In this state, the center contact follower 304*b* is in contact with the nonconductive index mark 313, and therefore bears no voltage. The entries at 5° and 355° correspond to the keying portions 315 of the conductive strips 312.

Each of the angular intervals listed above may correspond to the start and/or end of a particular appliance operation. For example, a first appliance operation may begin at 5° and end at 90° (see FIG. 19), where a second appliance operation begins. Likewise, the second appliance operation may end at 180°, where a third appliance operation begins. It is noted, however, that the angular intervals listed herein are merely exemplary, and that in practice, smaller or larger angular intervals may be used. For example, to accommodate a relatively large number of auxiliary operations, every 5° interval may correspond to a rotational position where one operation starts and another operation ends. This, of course, is simply a matter of design choice.

Regardless of the number of angular intervals employed, the center contact follower 304*b* bears a different voltage at each angular interval. These voltages are transferred to the center lead 302*b*, and provided to the A/D converter 21 as position signals (see FIG. 17). As previously indicated, the A/D converter 21 digitizes the position signals and provides the results to the processor 11. In response to the digitized position signals, the processor 11 generates controls signals and provides the same to the second machine components 19. The control signals cause one of the second machine components 19 to switch on and thereby receive a voltage signal from the voltage source 13, thus commencing an operation such as an agitation cycle of a clothes washer or other operation.

As described herein, the present invention advantageously increases the functionality of an appliance. While this invention has been described as having a preferred design, the present invention can be further modified within the spirit and scope of this disclosure. This application is therefore intended to cover any variations, uses, or adaptations of the invention using its general principles. For example, although the present invention has been described as being used in conjunction with a single block timer, it may also be used in conjunction with other types of timers such as double block timer. Further, this application is intended to cover such departures from the present disclosure as come within known or customary practice in the art to which this invention pertains and which fall within the limits of the appended claims.

Also, although three embodiments have been described to sense rotational position, and certain advantages are achieved by each embodiment, other position sensing mechanisms may alternatively be used in place of such disclosed position sensing mechanisms. For example, a position sensing mechanism which may be used with the present invention may incorporate a Hall effect position sensor or any other type of position sensing device.

What is claimed is:

1. A timer for controlling an appliance, comprising:

a camstack having a plurality of cam surfaces defined therein;

a switch block which cooperates with said plurality of cam surfaces to provide first switching operations for the appliance;

a sensor which detects rotation of said camstack, and generates position signals in response thereto; and a processor configured to receive said position signals and generate control signals in response thereto, wherein an auxiliary switching operation is performed in response to generation of said control signals.

2. The timer of claim 1, wherein rotation of said camstack relative to said switch block causes said first switching operations to occur.

3. The timer of claim 2, wherein:

said switch block includes a plurality of circuit blades, said plurality of circuit blades define a plurality of electrical terminals, and first machine components which are coupled to said plurality of electrical terminals are operated in response to occurrence of said first switching operations.

4. The timer of claim 3, wherein second machine components are operated in response to occurrence of said auxiliary switching operation.

5. The timer of claim 1, wherein:

said sensor includes (i) an auxiliary member having a circuit pattern positioned on a side thereof, and (ii) a number of conductive members positioned in contact with said side of said auxiliary member, rotation of said camstack causes rotation of said auxiliary member, rotation of said auxiliary member causes said circuit pattern to be advanced in a path of movement in contact with said number of conductive members, and said position signals are generated in response to said circuit pattern being advanced in said path of movement in contact with said number of conductive members.

6. The timer of claim 5, wherein:

a first end of said number of conductive members are coupled to said processor, a second end of said number of conductive members are mechanically biased against said auxiliary member, and said position signals are transmitted to said processor through said first end of said number of conductive members.

7. The timer of claim 5, wherein each of said number of conductive members include a conductive arm having an electrical terminal on a first end portion thereof and a circuit pattern contact portion on a second end portion thereof.

8. The timer of claim 5, wherein:

said auxiliary member includes a circuit board, and said circuit pattern includes a copper foil supported by said circuit board.

9. The timer of claim 1, further comprising a housing that contains said camstack therein, wherein:

said auxiliary member is secured to said camstack, and said a number of conductive members are mounted to said housing.

10. The timer of claim 9, wherein:

said camstack includes a hub, and said auxiliary member is secured to said hub.

11. The timer of claim 10, wherein:

said hub includes a first keying member, said auxiliary member includes a second keying member, and said first keying member cooperates with said second keying member so as to cause said auxiliary member to rotate dependently with said camstack.

12. The timer of claim 1, wherein:

said sensor includes an optical sensing assembly having (i) a first component, and (ii) a second component, rotation of said camstack causes rotation of said first component of said optical sensing assembly, said second component is mounted so that rotation of said first component causes relative movement between said first component and said second component, and said position signals are generated in response to said first component moving in relation to said second component.

13. The timer of claim 12, further comprising a housing that contains said camstack therein, wherein:

said second component is mounted to said housing.

14. The timer of claim 12, wherein:

said first component includes an auxiliary member mounted on said camstack, rotation of said camstack causes rotation of said auxiliary member, said second component includes an optical sensing device which includes an optical transmitter and an optical receiver, and said auxiliary member passes between said optical transmitter and said optical receiver during rotation of said auxiliary member.

15. The timer of claim 14, wherein:

said auxiliary member includes at least one aperture defined therein, and rotation of said auxiliary member causes said at least one aperture to be detected by said optical sensing device.

16. The timer of claim 15, wherein said at least one aperture is detected by said optical sensing device when said at least one aperture is aligned with said optical transmitter and said optical receiver such that light generated by said optical transmitter is transmitted through said at least one aperture and received by said optical receiver.

17. The timer of claim 12, further comprising a housing that contains said camstack therein, wherein:

said first component is mounted to said camstack, and said second component is mounted to said housing.

18. The timer of claim 12, wherein:

said optical sensing assembly includes a number of electrical terminals, said number of electrical terminals are coupled to said processor, and said position signals are transmitted to said processor through said number of electrical terminals.

19. The timer of claim 12, wherein:

said first component includes an auxiliary member mounted on said camstack, rotation of said camstack causes rotation of said auxiliary member, said second component includes an optical sensing device which includes (i) a first optical transmitter and receiver set, and (ii) a second optical transmitter and receiver set, each of said first optical transmitter and receiver set and said second optical transmitter and receiver set defines a sensing channel, said auxiliary member is located within said sensing channel during rotation of said auxiliary member.

20. The timer of claim 1, wherein:

said sensor includes a voltage sensing assembly having (i) a first component, and (ii) a second component, rotation of said camstack causes rotation of said first component of said voltage sensing assembly, said second component is mounted so that rotation of said first component causes relative movement between said first component and said second component, and said position signals are generated in response to said first component moving in relation to said second component.

21. The timer of claim 20, further comprising a housing that contains said camstack therein, wherein:

said second component is mounted to said housing.

22. The timer of claim 20, wherein:

said first component includes an auxiliary member mounted on said camstack, said auxiliary member has at least one resistive strip supported thereon, rotation of said camstack causes rotation of said auxiliary member, said second component includes (i) a body, and (ii) a number of conductive leads supported by said body, and said number of conductive leads is positioned in contact with said auxiliary member during rotation thereof.

23. The timer of claim 22, wherein at least one of said number of conductive leads is positioned in contact with said at least one resistive strip during rotation of said auxiliary member.

24. The timer of claim 20, further comprising a housing that contains said camstack therein, wherein:

said first component is mounted on said camstack, and said second component is mounted on said housing.

25. The timer of claim 20, wherein:

said first component includes (i) first and second conductive strips, and (ii) a resistive strip interposed between said first and second conductive strips.

26. The timer of claim 20, wherein:

said first component includes a resistive portion; and said position signals are generated in dependence upon relative position of said resistive portion in relation to said second component.

27. A timer for controlling an appliance, comprising:

a camstack having a plurality of cam surfaces defined therein;

a switch block which cooperates with said plurality of cam surfaces to provide first switching operations for the appliance;

a sensing assembly which detects rotation of said camstack, and generates position signals in response thereto, said sensing assembly including (i) an auxiliary member which rotates together with said camstack, and (ii) a number of conductive arms positioned in contact with said auxiliary member for enabling generation of said position signals as said auxiliary member and said camstack rotate in relation to said number of conductive arms; and a processor configured to receive said position signals and generate control signals in response thereto, wherein an auxiliary switching operation is performed in response to generation of said control signals.

28. A timer for controlling an appliance, comprising:

a camstack having a plurality of cam surfaces defined therein;

a switch block which cooperates with said plurality of cam surfaces to provide first switching operations for the appliance;

an optical sensing assembly which detects rotation of said camstack, and generates position signals in response thereto, said optical sensing assembly including (i) an auxiliary member which rotates together with said camstack, and (ii) an optical sensing device for generating said position signals in dependence upon optically detectable characteristics of said auxiliary member as said auxiliary member and said camstack rotate in relation to said optical sensing device; and a processor configured to receive said position signals and generate control signals in response thereto, wherein an auxiliary switching operation is performed in response to generation of said control signals.

29. A timer for controlling an appliance, comprising:

a camstack having a plurality of cam surfaces defined therein;

a switch block which cooperates with said plurality of cam surfaces to provide first switching operations for the appliance;

a voltage sensing assembly which detects rotation of said camstack, and generates position signals in response thereto, said voltage sensing assembly including (i) an auxiliary member which rotates together with said camstack, said auxiliary member having at least one resistive strip supported thereon, and (ii) a voltage sensing element positioned in contact with said resistive strip on said auxiliary member for enabling generation of said position signals as said auxiliary member and said camstack rotate in relation to said voltage sensing element; and a processor configured to receive said position signals and generate control signals in response thereto, wherein an auxiliary switching operation is performed in response to generation of said control signals.

30. A timer for controlling an appliance, comprising:

a camstack having a plurality of cam surfaces defined therein;

a switch block which cooperates with said plurality of cam surfaces to provide first switching operations for the appliance;

means for detecting rotation of said camstack and generating position signals in response thereto; and a processor configured to receive said position signals and generate control signals in response thereto, wherein an auxiliary switching operation is performed in response to generation of said control signals.

31. The timer of claim 30, wherein rotation of said camstack relative to said switch block causes said first switching operations to occur.

32. The timer of claim 31, wherein:

said switch block includes a plurality of circuit blades, said plurality of circuit blades define a plurality of electrical terminals, and first machine components which are coupled to said plurality of electrical terminals are operated in response to occurrence of said first switching operations.

33. The timer of claim 32, wherein second machine components are operated in response to occurrence of said auxiliary switching operation.

34. The timer of claim 30, wherein:

said detecting and generating means includes (i) an auxiliary member having a circuit pattern positioned on a side thereof, and (ii) a number of conductive members positioned in contact with said side of said auxiliary member, rotation of said camstack causes rotation of said auxiliary member, rotation of said auxiliary member causes said circuit pattern to be advanced in a path of movement in contact with said number of conductive members, and said position signals are generated in response to said circuit pattern being advanced in said path of movement in contact with said number of conductive members.

35. The timer of claim 34, wherein:

a first end of said number of conductive members are coupled to said processor, a second end of said number of conductive members are mechanically biased against said auxiliary member, and said position signals are transmitted to said processor through said first end of said number of conductive members.

36. The timer of claim 34, wherein each of said number of conductive members include a conductive arm having an electrical terminal on a first end portion thereof and a circuit pattern contact portion on a second end portion thereof.

37. The timer of claim 34, wherein:

said auxiliary member includes a circuit board, and said circuit pattern includes a copper foil supported by said circuit board.

38. The timer of claim 30, further comprising a housing that contains said camstack therein, wherein:

said auxiliary member is secured to said camstack, and said a number of conductive members are mounted to said housing.

39. The timer of claim 38, wherein:

said camstack includes a hub, and said auxiliary member is secured to said hub.

40. The timer of claim 39, wherein:

said hub includes a first keying member, said auxiliary member includes a second keying member, and said first keying member cooperates with said second keying member so as to cause said auxiliary member to rotate dependently with said camstack.

41. The timer of claim 30, wherein:

said detecting and generating means includes an optical sensing assembly having (i) a first component, and (ii) a second component, rotation of said camstack causes rotation of said first component of said optical sensing assembly, said second component is mounted so that rotation of said first component causes relative movement between said first component and said second component, and said position signals are generated in response to said first component moving in relation to said second component.

42. The timer of claim 41, further comprising a housing that contains said camstack therein, wherein:

said second component is mounted to said housing.

43. The timer of claim 41, wherein:

said first component includes an auxiliary member mounted on said camstack, rotation of said camstack causes rotation of said auxiliary member, said second component includes an optical sensing device which includes an optical transmitter and an optical receiver, and said auxiliary member passes between said optical transmitter and said optical receiver during rotation of said auxiliary member.

44. The timer of claim 43, wherein:

said auxiliary member includes at least one aperture defined therein, and rotation of said auxiliary member causes said at least one aperture to be detected by said optical sensing device.

45. The timer of claim 44, wherein said at least one aperture is detected by said optical sensing device when said at least one aperture is aligned with said optical transmitter and said optical receiver such that light generated by said optical transmitter is transmitted through said at least one aperture and received by said optical receiver.

46. The timer of claim 41, further comprising a housing that contains said camstack therein, wherein:

said first component is mounted to said camstack, and said second component is mounted to said housing.

47. The timer of claim 41, wherein:

said optical sensing assembly includes a number of electrical terminals, said number of electrical terminals are coupled to said processor, and said position signals are transmitted to said processor through said number of electrical terminals.

48. The timer of claim 41, wherein:

said first component includes an auxiliary member mounted on said camstack, rotation of said camstack causes rotation of said auxiliary member, said second component includes an optical sensing device which includes (i) a first optical transmitter and receiver set, and (ii) a second optical transmitter and receiver set, each of said first optical transmitter and receiver set and said second optical transmitter and receiver set defines a sensing channel, said auxiliary member is located within said sensing channel during rotation of said auxiliary member.

49. The timer of claim 30, wherein:

said detecting and generating means includes a voltage sensing assembly having (i) a first component, and (ii) a second component, rotation of said camstack causes rotation of said first component of said voltage sensing assembly, said second component is mounted so that rotation of said first component causes relative movement between said first component and said second component, and said position signals are generated in response to said first component moving in relation to said second component.

50. The timer of claim 49, further comprising a housing that contains said camstack therein, wherein:

said second component is mounted to said housing.

51. The timer of claim 49, wherein:

said first component includes an auxiliary member mounted on said camstack, said auxiliary member has at least one resistive strip supported thereon, rotation of said camstack causes rotation of said auxiliary member, said second component includes (i) a body, and (ii) a number of conductive leads supported by said body, and said number of conductive leads is positioned in contact with said auxiliary member during rotation thereof.

52. The timer of claim 51, wherein at least one of said number of conductive leads is positioned in contact with said at least one resistive strip during rotation of said auxiliary member.

53. The timer of claim 49, further comprising a housing that contains said camstack therein, wherein:

said first component is mounted on said camstack, and said second component is mounted on said housing.

54. The timer of claim 49, wherein:

said first component includes (i) first and second conductive strips, and (ii) a resistive strip interposed between said first and second conductive strips.

55. The timer of claim 49, wherein:

said first component includes a resistive portion; and said position signals are generated in dependence upon relative position of said resistive portion in relation to said second component.

* * * * *